US005821879A

United States Patent [19]

Liepmann

[11] Patent Number: 5,821,879

[45] Date of Patent: Oct. 13, 1998

[54] VEHICLE AXLE DETECTOR FOR ROADWAYS

[75] Inventor: Till W. Liepmann, Santa Monica, Calif.

[73] Assignee: Pacific Sierra Research Corp., Santa Monica, Calif.

[21] Appl. No.: 691,957

[22] Filed: Aug. 5, 1996

[51] Int. Cl.[6] ..... G08G 1/04

[52] U.S. Cl. ..... 340/942; 340/933; 340/935; 340/936

[58] Field of Search ..... 340/942, 928, 340/933, 934, 935, 936, 937, 555, 556, 905; 250/559.24; 364/436, 456

[56] References Cited

U.S. PATENT DOCUMENTS

| | | | |
|---|---|---|---|
| 2,366,152 | 12/1944 | Lauterbach | 340/942 |
| 3,872,283 | 3/1975 | Smith et al. | 340/942 |
| 5,636,028 | 6/1997 | Stringer et al. | 356/383 |

OTHER PUBLICATIONS

Lu, Jian., Traffic Data Logical Detection by Infrared Sensor Array., ITE 1993 Compendium of Technical Papers, 493–497.

Haberman, Richard, Mathematical Models, Prentice–Hall, Inc. (1977) pp. 259–298.

Greenshields, Bruce D., A Study of Highway Capacity, Hiighway Research Board, Dec. 6–7,1934, pp. 448–477.

U.S. Department of Transporation, Federal Highway Administration, The 1985 Highway Capacity Manual, Apr. 1986.

*Primary Examiner*—Jeffery A. Hofsass
*Assistant Examiner*—Ashok Mannava
*Attorney, Agent, or Firm*—Wagner, Middlebrook & Kimbell

[57] ABSTRACT

A system for monitoring traffic flow on multi-laned roadways. The system includes a plurality of radiation sources such as light emitting diodes, LEDs and a corresponding set of radiation detectors such as photo diodes. The radiation sources and detectors form a crossed array as well as direct paths across the roadway. By correlating radiation beam interruptions including the time and order of interruption, a signal processor such as a computer is able to determine traffic parameters for each lane. Multiple beams in parallel aid the reliability of the system. Using retroreflectors with the radiation sources and detectors on the same side of the roadway simplifies installation.

22 Claims, 27 Drawing Sheets

FIG. 5
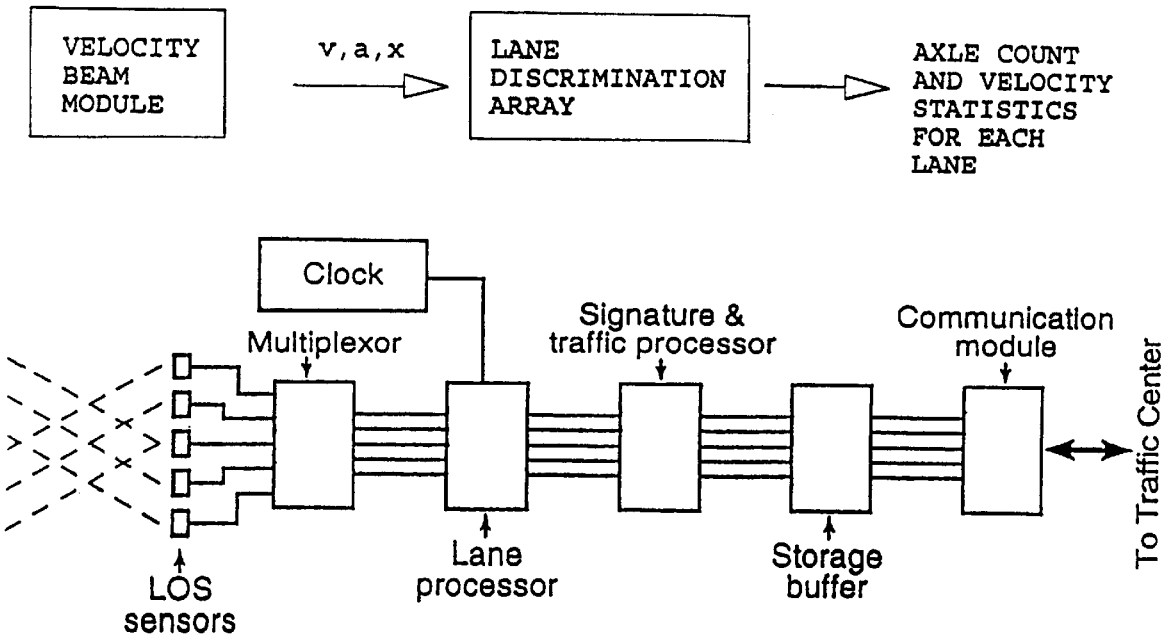
FIG. 5A
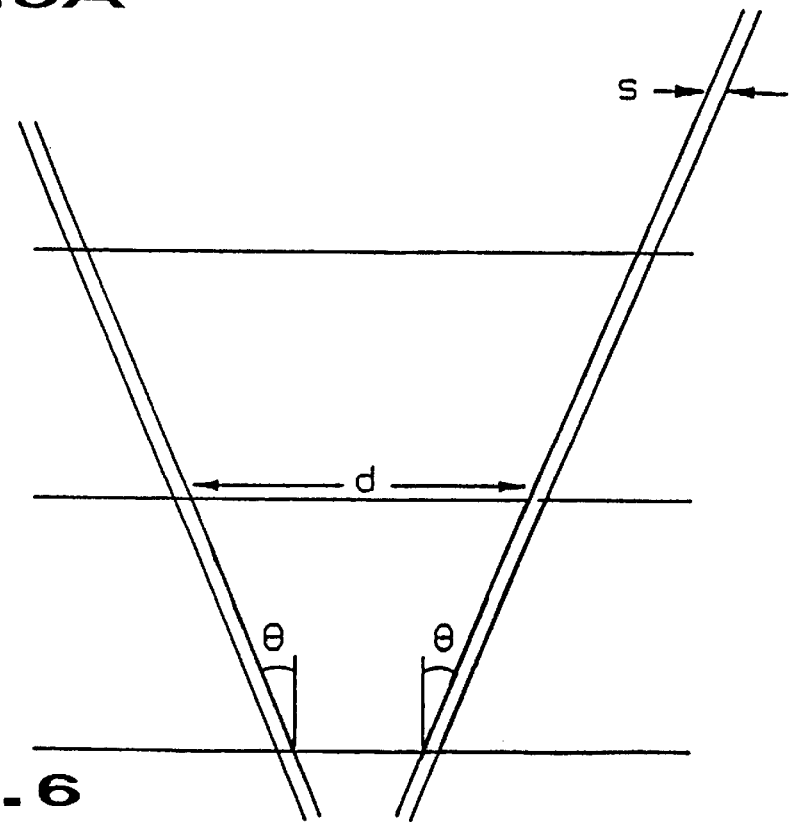
FIG. 6

(a) simulated multilane traffic FIG. 9A
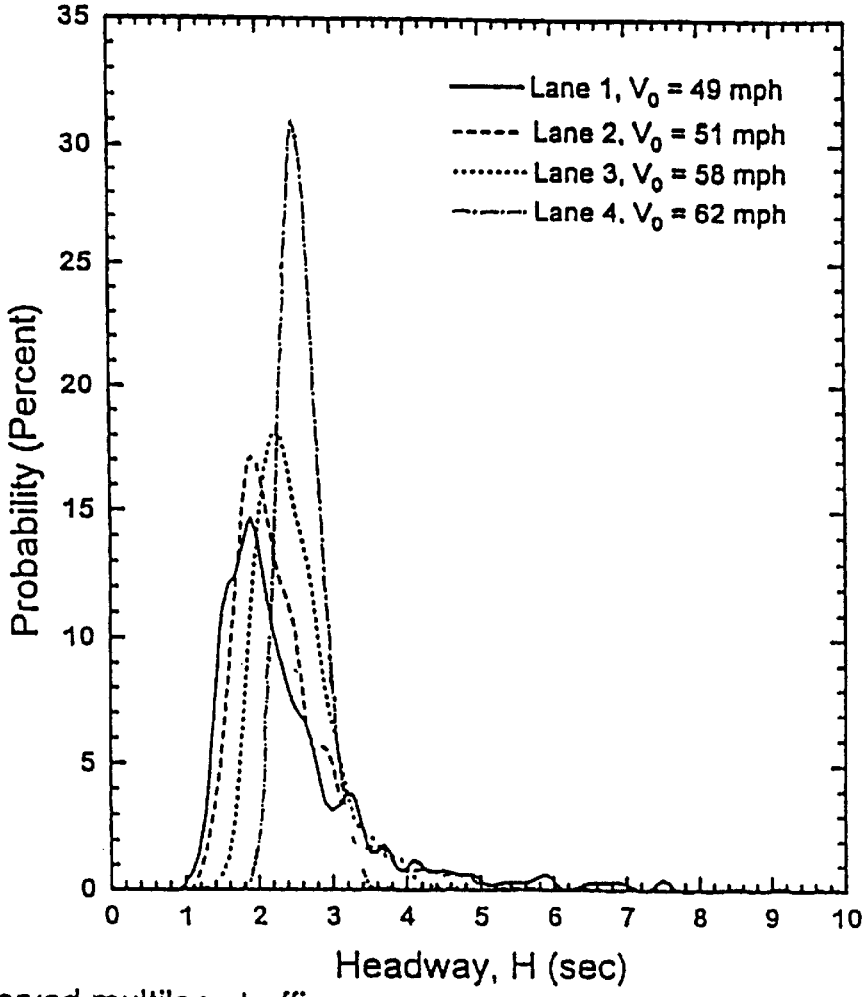
(b) observed multilane traffic
LONG ISLAND EXPRESSWAY LEVEL OF SERVICE C FIG. 9B
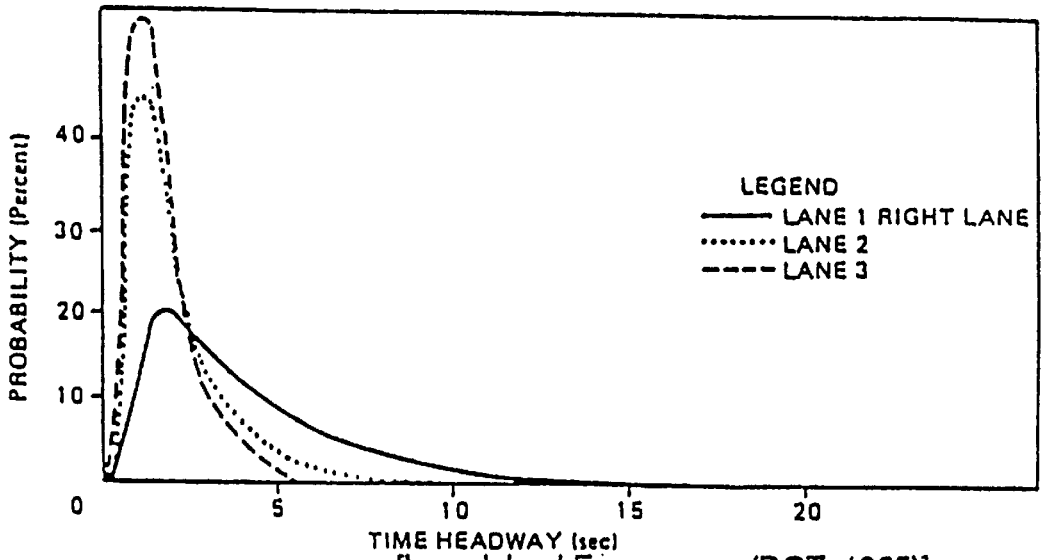
[Long Island Expressway (DOT, 1985)]

(a) $S = 0.25\ D_W$ (b) $S = 0.50\ D_W$

BLOCK DIAGRAM FOR ONE EMITTER/DETECTOR CHANNEL

| FIG. 18A | FIG. 18B | FIG. 18C |
|---|---|---|

PC ADAPTER CARD CTM-05

PC COMPUTER

| FIG.19A | FIG.19B |
| --- | --- |

TOP VIEW

VEHICLE AXLE DETECTOR FOR ROADWAYS

REFERENCE TO RELATED APPLICATION(S)

This application claims the benefit of U.S. Provisional Application(s) No. 60/002,217 filed Aug. 11, 1995.

BACKGROUND OF THE INVENTION

Traffic control and roadway maintenance management require that traffic loading of roadways be determined. One accurate and inexpensive method of determining traffic load is by counting axles through tapeswitch sensors and air switches. These sensors provide detection of wheels for each lane of the roadway without the permanent installation required by video, microwave, radar and inductive-loop sensors.

Tapeswitch and air switch axle counters suffer from three serious problems: short lifetime, installation safety issues, and the traffic interruption required for installation. However, the alternative methods also have problems that prevent their replacing tapeswitch vehicle counters. Automatic video camera vehicle counters require complex software, permanent overhead installation, have difficulty making velocity measurement, and require massive data processing. Overhead infrared vehicle counters can only measure one lane at a time, and require permanent installation. Commonly used axle detector systems using video cameras (or machine vision) do not count axles directly but use images of vehicles to deduce the axle count. Furthermore, video systems are not as rugged, simple and compact as simple non-contact LED light sources and photodetectors. Also, video systems are mounted on a pole, whereas this type of sensor can be located at the level of the roadway, and does not distract the drivers.

BRIEF DESCRIPTION OF THE INVENTION

This need provides an opportunity to develop a Line of sight Axle Detector (LAD) that counts axles using interrupted light beams arranged in a proprietary array. A special computer algorithm is used to optimize traffic detection, thereby reducing the error rate. Detection is via the vehicle tires and wheels, which are opaque to light and infrared radiation.

I have conceived a tapeswitch compatible axle detection sensor Line of Sight axle detector (LAD) that overcomes the above mentioned problems. Based on a unique counting technique conceived for this purpose, I use non-contact line-of-sight (LOS) sensor (optical, infrared or ultrasonic sensors) that can detect the wheels of vehicles without any roadway modification. Further, the system employing such sensors is able to measure vehicle counts, lane displacement, lane changes, velocity, headway, gap (distance between vehicles), axle counts, and wheelbase. The key to using these sensors is in the method used to detect the passage of several vehicles simultaneously. By angling these sensors and using a source on the opposite side of the roadway, the computer of the system can determine the presence of a vehicle axle and the lane in which the axle is located. FIG. 1, described below, shows this schematically. Multiple sensors allow the LAD computer to detect several vehicles in different lanes simultaneously and uniquely. For example (referring to FIG. 1), a vehicle traveling in lane (1) will block sensor a, then b, then c and so on. However, if that same vehicle is traveling in lane (2), it will block sensor a, then b, then d, then c and so on. The computer can use the sensor blocking logic and the time between LOS sensor signals to determine the lane, speed, headway, gap, axle counts, and wheel base. The output can be made tape-switch compatible or, as part of a traffic management system, operating in real time via a telephone date link. Since the technique is non-contact, there is no wear, and dangerous installation is not required. This technique will be low cost, easily to deploy, reliable, unobtrusive and provide lane definition over four lanes. The unit can be moved from place to place, since no permanent installation is required. The redundance in LOS sensors and internal computer software will protect the performance from road debris, snow, rain and other obstacles. The photo detectors and LED sources are safe and have lifetimes of thousands of hours, making the operating cost of the LAD less than all other technologies.

BRIEF DESCRIPTION OF THE DRAWINGS

This invention may be more clearly understood with the following detailed description and by reference to the drawings in which:

FIG. 5 is a simplified system flow chart;

FIG. 5A is a more comprehensive data processing flow chart;

FIG. 6 is a graphical representation of VBM geometry;

FIG. 9 comprises a pair of graphical representations of (a) headway vs probability (simulated) and (b) headway vs probability (observed);

DETAILED DESCRIPTION OF THE INVENTION

Figure 1:
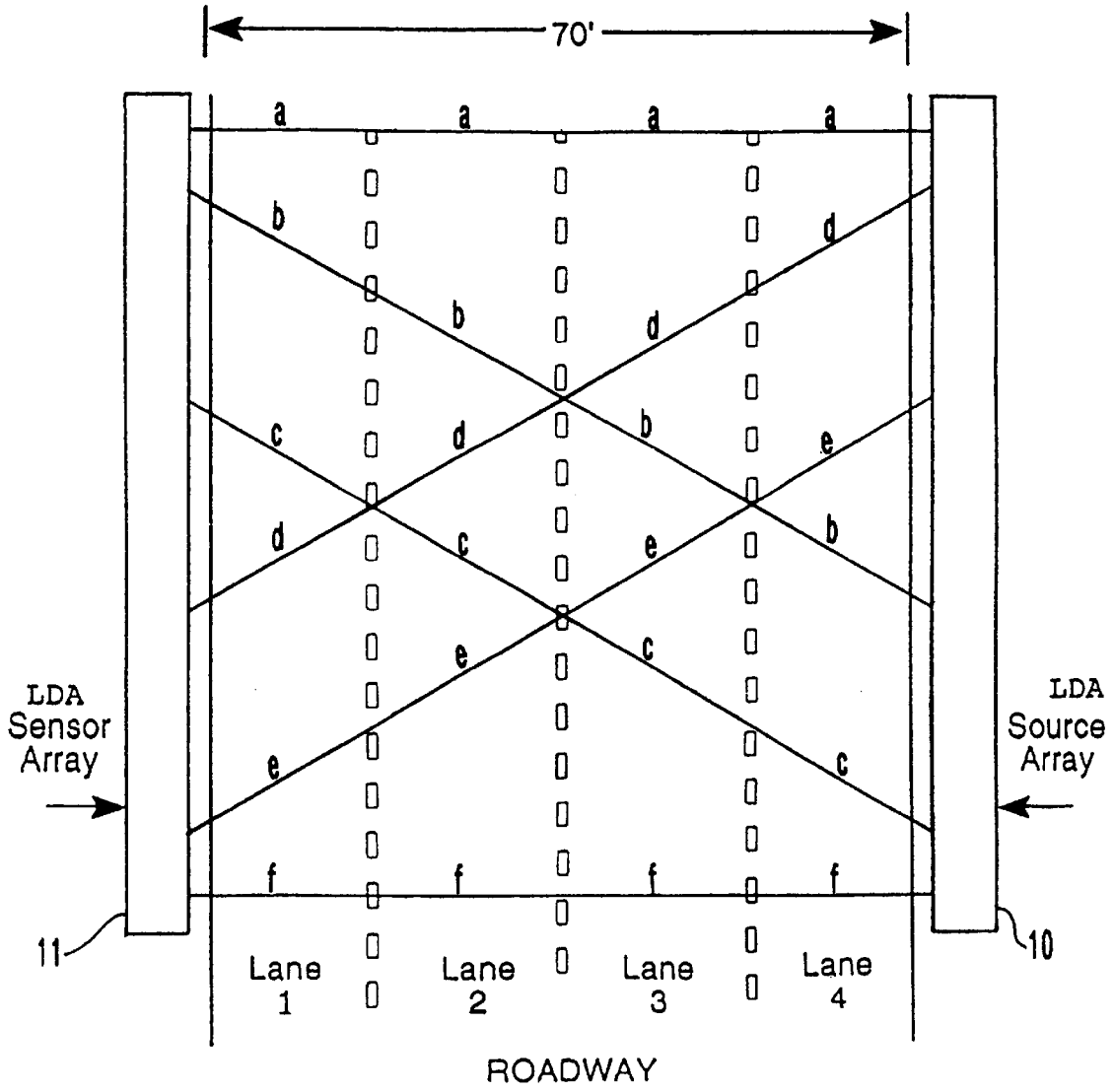
FIG. 1 is a top plan view of a traffic sensor array in a multi laned roadway in accordance with this invention.

Now referring to FIG. 1 in connecting with FIGS. 2–5, a typical installation of this invention may be seen. In FIG. 1, a roadway RW with four lanes 1–4 in one direction is shown with a light source array 10 on one side of the roadway RW and a sensor array 11 on the opposite side of the roadway. The light sources preferably are light emitting diodes (LED) and the sensors are preferably Schmitt trigger silicon photodetectors. Five light paths a–e are shown. The light source array 10 is powered by a power supply unshown and the sensors are coupled to the signal processing system of FIG. 5A. Each path a–e may be either a single beam or dual beams spaced by a predetermined fixed spacing apart as discussed below.

THEORY

Figure 2:
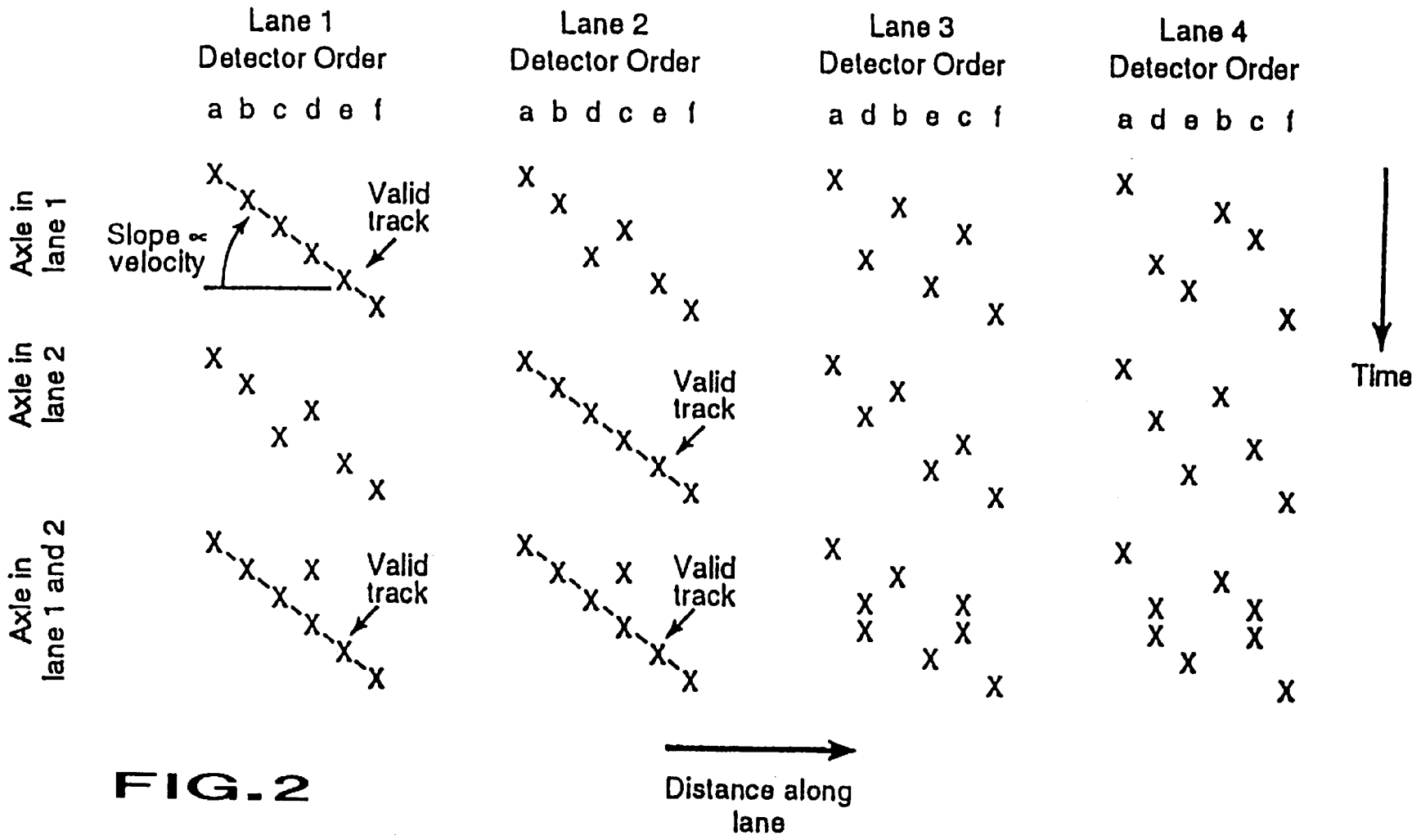
FIG. 2 is a time line display illustrating lane discrimination employing this invention.

The line of sight axle detector LAD crossed LOS sensor geometry of FIG. 1 makes the detection and tracking of individual axles possible. Axles in the different lanes can then be discriminated by the order in which the LOS sensors are blocked. A vehicle axle traveling in lane 1 alternately blocks the LOS of each individual sensor in order; that is, a,b,c,d,e,f. FIG. 2 shows this graphically. An axle in lane 2, on the other hand, blocks the sensors in a different order: a,b,d,c,e,f. Similarly, the detection of vehicles in all four lanes are uniquely determined by the order of detector signals.

The LAD geometry and detection technique compensate for simultaneous blocking of the detectors by different axles in different lanes. FIG. 2 illustrates the detection time line for three cases: an axle traveling in lane 1, an axle traveling in lane 2, and two axles simultaneously traveling in lanes 1 and 2. A valid track (or count) of an axle in a lane requires that there be a full sequence of hits for a unique sequence (i.e., a,b,c,d,e,f for lane 1) of sensors in time. This is somewhat analogous to a winning sequence in the game of tic-tac-toe. Further, it is clear that this approach will discriminate between any number of axles in any combination, including four axles (one in each lane) simultaneously. This approach will even work with two-way traffic. Finally, the velocity of each axle is measured by the slope of the track line.

Figure 3:
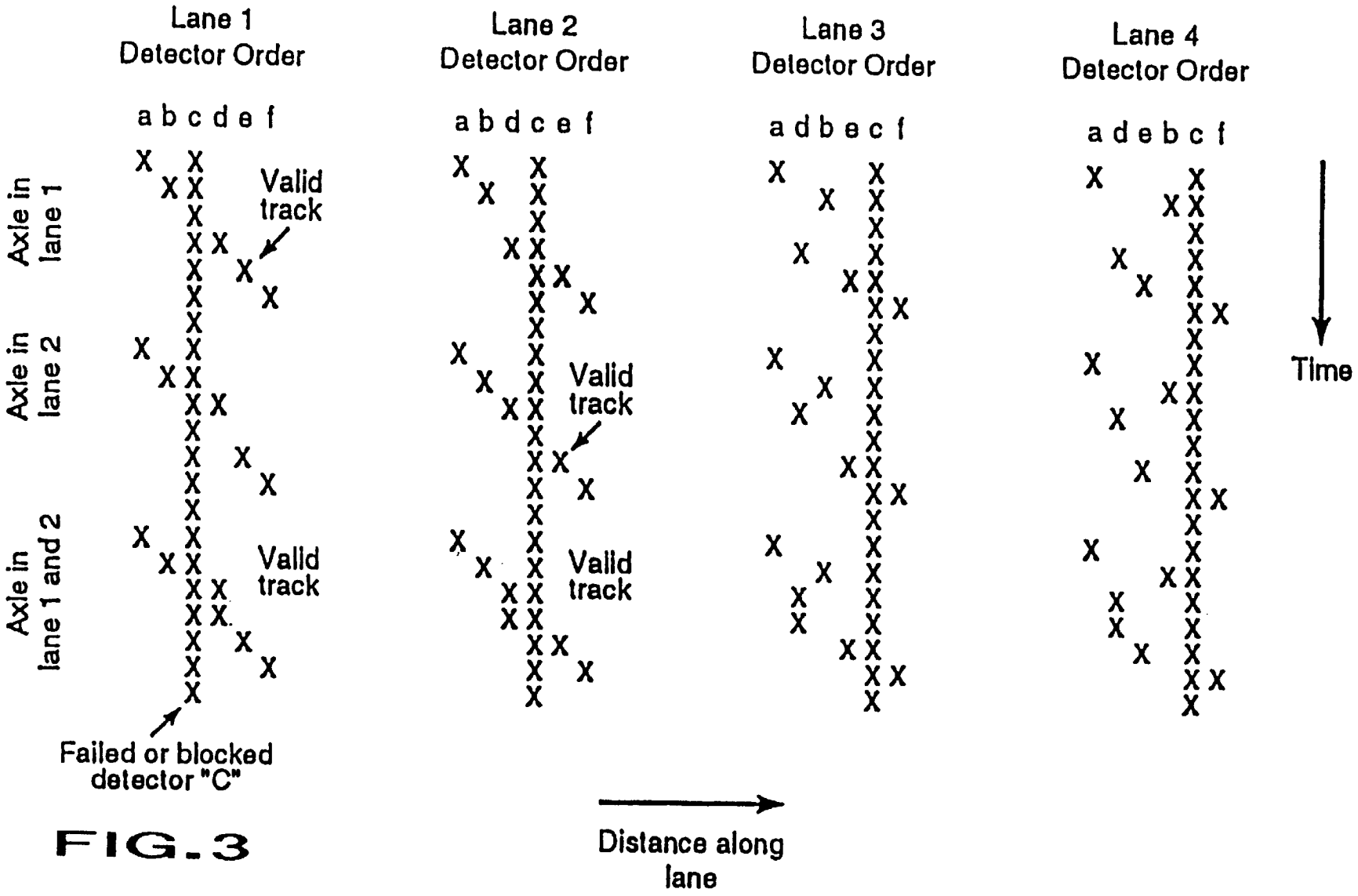
FIG. 3 is a time line display similar to FIG. 2 with one blocked sensor.

The LAD is designed to be fault tolerant, since roadway debris and weather will occasionally block the LOS of one or more sensors. FIG. 3 shows the same detection example of FIG. 2, only with a blocked sensor "C". Note that the redundant detectors prevent that failure from causing a missed or superfluous axle count(s). Adding sensors will increase the robustness of the approach.

Figure 4:
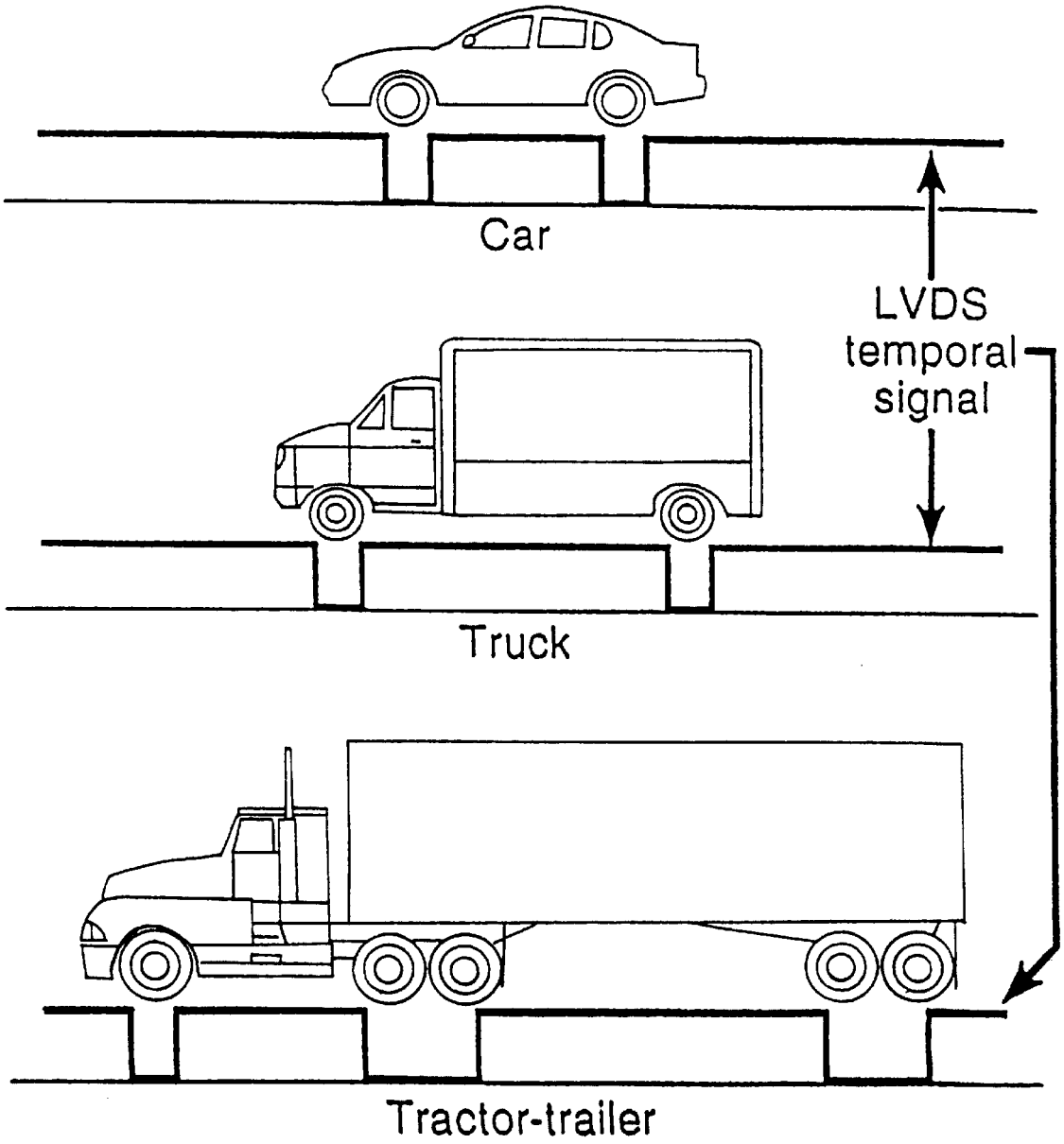
FIG. 4 is a display of sensed signal signatures associated with different types of sizes of vehicles.

Vehicles are identified by sets of axles traveling at the same velocity and with the same wheel diameter. The vehicle is bounded by limits on the wheelbase. The wheel diameter is measured by the width of the LOS sensor "off" time multiplied by the velocity. Wheelbase is measured by the distance between the axles of the vehicle, measured by the time between the axles of the same vehicle multiplied by the velocity. FIG. 4 shows the LAD and the vehicle classification concept. Spatial headway is measured as the time between the front axles of different vehicles, with a correction factor to account for the vehicle overhang (the distance from the wheel to the vehicle bumper).

The analysis of the LAD data also determines the lane displacement of the axle in the lane. This is determined by the signal timing between adjacent detectors in the lane. Because of the angling of the LOS detectors, the time between signals is proportional to the position of the axle in the lane.

VELOCITY ESTIMATES AND SINGLE VS TWIN BEAM APPROACH

The LAD multi-lane vehicle axle counting technique of this invention uses a method of opening tracking gates at predicted time intervals beyond initial wheel detection. This method permits simultaneous tracking of closely spaced vehicles in the same lane, or in multiple lanes. The performance of such techniques depends on the precision of velocity estimates derived from initial beam interruptions. This section summarizes an analysis of two methods for estimating vehicle velocity from the interruptions of a pulsed beam caused by wheel interference.

The single beam (1B) method estimates velocity from the number of interruptions caused by a wheel of an assumed diameter interrupting the beam. In addition to granularity errors, this method also suffers from errors induced by assuming some average wheel diameter when, in fact, wheel sizes vary considerably. One problem discovered with the method is errors during multiple, near simultaneous axles cause exaggerated velocity errors.

Subsequent to this analysis, it was decided to employ a CW or quasi-CM (high pulse rate) beam. In this case, velocity estimates will be very precise, obviating the need to calculate the variance of such estimates. This section is intended to provide guidance should pulse-beam velocity estimates be reconsidered in the future.

The dual beam (2B) method uses the time between the onset of interruptions at two beams separated by a known distance. Granularity due to the finite time between light source pulses is the source of error in this estimate. However, light pulses with a frequency of 2 kHz (or more) will reduce the error to insignificance.

NUMERICAL RESULTS

DUAL BEAM

The dual beam velocity estimate is $$\hat{v}_{2B} = \frac{D_0}{n\Delta t}$$

where $D_0$ is the known distance between the beams, n is the random number of pulses between the time the first and second beam crossing, and $\Delta t$ is the time between pulses (i.e., $R=(\Delta t)^{-1}$ is the pulse rate). Note that the only random element in $\hat{v}_{2B}$ is n since the time between beam LOS crossing and beam interruption is random.

Assuming a wheel diameter $\overline{D}$ equal to the average for a typical vehicle distribution, the single beam estimate is $$\hat{v}_{1B} = \frac{\overline{D}_0}{m\Delta t},$$

where m is the number of pulses interrupted by the wheel moving through the beam LOS, and $\Delta t=R^{-1}$ as above. In addition to the uncertainty introduced by the random interval between crossing the beam LOS and interrupting the first pulse, there is also a random error caused by assuming $\overline{D}$ is fixed when it should be regarded as random. We assume actual wheel diameters are distributed over the interval $[D_1, D_2]$.

The following parameter values were chosen for the tabulated results below: $D_0$=30 cm, $D_1$=40 cm, and $D_2$=80 cm. The true, but unknown, vehicle velocity is fixed at v=60 mph. The pulse rate (in pulses per sec.) is varied as shown in Table 1 below, and the mean and standards deviation (s.d.) are calculated for each velocity estimate in mph.

TABLE 1

| | MEAN (mph) | | S.D. (mph) | |
|---|---|---|---|---|
| Pulse Rate | 1B | 2B | 1B | 2B |
| 300 | 64.0 | 61.1 | 15.6 | 8.0 |
| 500 | 63.6 | 60.5 | 14.5 | 5.5 |
| 1000 | 63.4 | 60.1 | 14.0 | 2.0 |

OBSERVATIONS

1. The Single Beam Method 1B appears to be biased regardless of pulse rate (i.e., $E(\hat{v}_{1B}|v)\rightarrow\kappa_1\neq v$ as $R\rightarrow\infty$), while the Dual Beam Method 2B is unbiased in the limit $R\rightarrow\infty$.
2. The Single Beam Method 1B appears to be inconsistent with respect to R (i.e., $VAR(v_{1B}|v)\rightarrow\kappa_2\neq 0$ as $R\rightarrow\infty$), while the Dual Beam Method 2B is consistent with respect to R.
3. The performance of the Single Beam Method 1B is actually worse than portrayed here since we assume that the distribution of wheel diameters was known while, in fact, this will probably not be the case.
4. The calculations for the Dual Beam Method 2B assumes that the pulses for both beams are in phase. Since VAR $(\hat{v}_{2B}|v)$ is a function of the lag $\lambda$ between the beam pulse trains, it would be possible minimize VAR $(\hat{v}_{2B}|v)$ by adaptively varying $\lambda$ as a function of past velocity estimates.

The conclusion of this analysis is that the performance of a dual beam velocity gate greatly improves the LAD system performance, both in accuracy and reliability.

AXLE COUNT/LANE DISCRIMINATION LOGIC

INTRODUCTION

The logic described in this section specifically exploits two key features of the LAD system as developed: lane discrimination inferred from the sequence of beam interruptions, and the virtual impossibility of failure to detect axles i.e., $P_D=1$ in a single traffic lane. The later is a consequence of the fact that sensor failures due to power outage, component breakdown, non-vehicle related beam interruptions, etc. result in beam interruptions that are equivalent to a "detection". Hence, viable logic designs must focus on false detections rather than failures to detect.

The situation becomes more complex when multiple-lanes are considered because of the "shadowing" of one axle by another. Note that both axles can be considered detected in a shadowing episode since the beam is interrupted in their presence. Identifying vehicle tracks through the array when shadowing and non-vehicle beam interruptions are occurring is the challenge.

The approach suggested here uses time windows or gates within the time-line of each sensor to associate detections and thereby identify vehicle tracks. Coupled with the beam ordering concept, this approach not only counts axles, but also identifies lanes and estimates vehicle velocity. Gates are "opened" by means of a velocity-beam module (VBM) which precedes the lane-discrimination array (LDA) as shown in FIG. 5.

LOGIC OVERVIEW

The interaction of the velocity-beam module VBM and the lane discrimination array LDA is shown in FIG. 5.

Traffic enters the VBM and upon exit the following parameters are estimated for each axle:

$\hat{v}$=axle velocity estimate $\hat{a}$=axle accelerating estimate $\hat{x}$=axle position estimate For each of exposition we assume that multiple velocity estimates within the VBM are linear in the time (or fitted with a linear regression) providing a constant acceleration estimate $\hat{a}$. Generalization to a non-linear (e.g., polynomial) fit for multiple velocity estimates is straightforward. If only a single velocity estimate is available from the VBM, then we set $\hat{a}=0$.

The triple $(\hat{v},\hat{a},\hat{x})$ for each axle detection in the velocity beam module VBM is used to open gates within the LDS. Since no lane indications are obtained in the VBM, the LDS must assume that the detected axle could be in any lane. The function of the LDA is to assign a lane to each detected axle from the VBM. Axle counts and velocity statistics may then be recorded on a lane-by-lane basis.

VELOCITY BEAM MODULE (VBM)

The VBM of FIG. 5 employs at least two velocity beams as shown in FIG. 6. Free parameters include velocity beam-component separation (s), distance between the velocity beams (d) and the slant angle ($\theta$). Optimal values of (s, d, $\theta$) can be found through Monte Carlo simulation. The objective of the optimization should be to maximize to the probability of detecting an axle by at least one velocity beam.

Since shadowing (two wheels from two vehicles blocking the same beam) and overtaking are the dominant sources of error and can lead to inaccurate velocity estimates, one further rejects velocity estimates (and corresponding axle counts) that lie outside some acceptance interval. In practice that interval should be adaptively determined by an error bound about the average of recent velocity estimates. For purpose here, a simple ±10% of the true velocity should suffice.

Considering that failure to obtain acceptable velocity estimates from beam interruptions is most likely due to shadowing for small s, as discussed, the axle counts out of the VBM will be biased low. However, shadowing implies the presence of at least two vehicles in the VBM, so a reasonable way to reduce this bias is to count two axles for every inadmissible velocity estimate. Of course, lane assignment for such vehicles will not be possible since the LDA requires accurate velocity estimates.

The component spacing s should effect $P_D$ independently of d and $\theta$. Overtaking and shadowing effects suggest $P_D$ should vary inversely with s until s is so small that the sample rate of beam interrogation limits further improvements in $P_D$ and the variance of the velocity estimate. At this point, a high sample rate would be required to increase $P_D$. Also note that setting $\theta=0$ is highly desirable so that the positional estimate $\hat{x}$ is independent of lane displacement. If $P_D$ for $\theta=0$ is reasonably close to its maximum over the range $$\theta\epsilon[0, \pi/2],$$

then $\theta=0$ should be used.

LANE DISCRIMINATION ARRAY (LDA)

Lane discrimination follows the basic concept, where four beams, e.g., b,c,d, & e of FIG. 1 are employed in a crossing pattern. Clearly, more beams can be used to improve reliability and accuracy. Since lane geometry restricts the length of this array measured along the direction of traffic, a single array is highly susceptible to shadowing induced errors (i.e., clearing a shadowing episodes requires a distance in excess of the array dimension). Accordingly, placing a second array, namely a duplication of source 10 and sensors 11 a distance d' from the first will increase the probability that at least one array will avoid shadowing of a given axle. Simulation should be used to optimize d'.

The $(\hat{v},\hat{a},\hat{x})$ output of the VBM is used to open intervals or windows along the time lines for each sensor beam response. Independent algorithms operate for each of the four lanes. Take Lane 1 as an example. A window is opened for the first beam encountered in Lane 1. The length of this window can be determined from the error induced by the uncertainty in expected time of arrival (ETA) due to the statistics of $(\hat{v},\hat{a},\hat{x})$, or it can be optimized in simulation. In any case, since the axle detected in the VBM will almost certainly break the beam within the window, if the beam is never interrupted (i.e., "off") within this interval, then this vehicle can be assumed to be in a lane other than Lane 1.

If there is non-empty set of "off" times within the window, then a window is opened on the timeline for the next beam in the sequence unique to Lane 1 as shown in several examples in FIG. 3. In situation (3*a*) a single off interval $[t_1,t_2]$ occurs at sensor 1 within window $w_1$, resulting in window $w_2$ opening at beam 2. The start time $t_5$ of $w_2$ is given by $t_5=t_3-\delta$, where $\delta$ is to be optimized in simulation, $$t_3 = \frac{\Delta x}{\hat{v}_1}, \Delta x$$

is the beam separation in Lane 1 and $\hat{v}_1$ is the velocity estimate update of $(\hat{v},\hat{a},\hat{x})$ using the leading wheel edge crossing of the first beam at time $t_1$. Note that we assume $a=\hat{a}=0$ for this simple example. Likewise the closure of $w_2$ occurs at $t_6=t_4+\delta$, where $t_4=$ $$t_4 = \frac{\Delta x}{\hat{v}_2},$$

and $\hat{v}_2$ is derived from the trailing edge position in Lane 1 at time $t_4$.

Figure 7C:
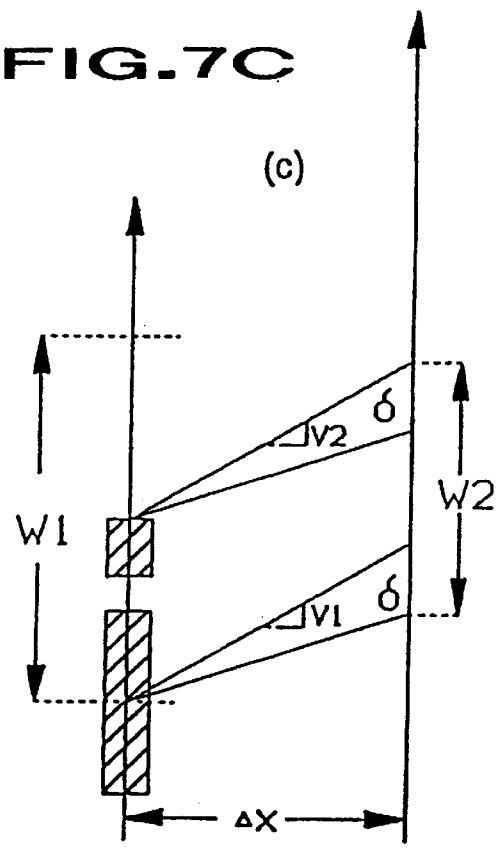
FIG. 7 constitutes three different graphical representation of window opening logic.
Figure 7B:
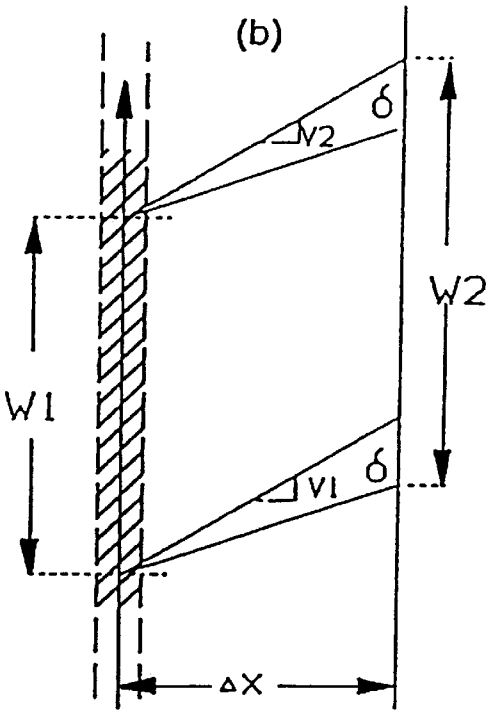
Figure 7A:
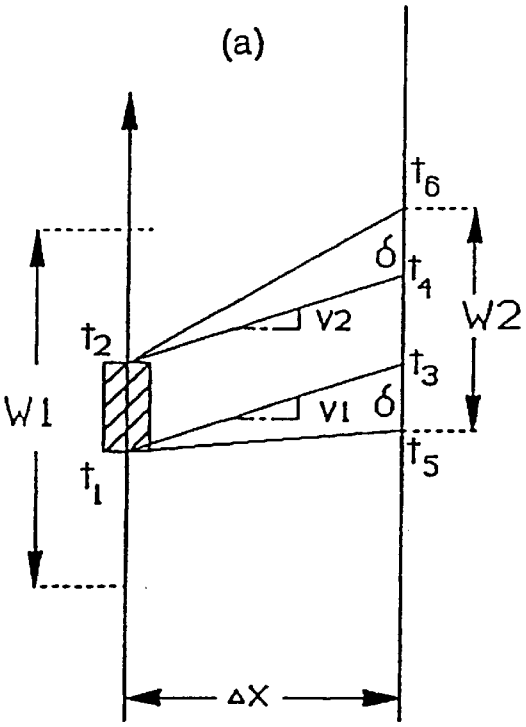

FIGS. 7*b* and 7*c* generalize the procedure discussed above for FIG. 7*a* to the cases where a sensor fails (always "off"), and where there are more than one "off" interval, respectively. The opening of windows continues in this manner until either: (1) the chain is interrupted by the beam being "on" throughout the window, or (2) all beams yield a detection within their respective windows. In the former case, no lane assignment can be made (perhaps due to a lane change), and in the latter case the axle may be assigned to the lane in question. In high traffic density more than one lane may be aligned to a given axle detection out of the VBM. This axle should be counted once, but it should not contribute to the update of lane velocity statistics.

The window size parameter $\delta$ is expected to have dramatic effect on LDA performance. If $\delta$ is too small, some legitimate chains will be broken and missed lane assignments will result. On the other hand, if $\delta$ is too large, multiple lane assignments for a single axle will result. Hence it is important to optimize the choice of $\delta$ as discussed below.

PARAMETER OPTIMIZATION

The VBM and LDA may be tested separately. After noting the traffic density regime for which algorithm performance rapidly deteriorates, the parameters controlling the logic for the VBM and LDA should be optimized to improve performance within this regime. Clearly, more attention should be given to the module that breaks down under the most benign traffic conditions. Note that for the VBM, breakdown consists of excessive failures to detect an axle, while for the LDA breakdown occurs when no lane assignments can be made due to too many window detections.

TRAFFIC SIMULATION AND SYSTEM OPTIMIZATION

The LAD system offers the ability to collect highly time-resolved traffic statistics for multilane highways without the usual deployment difficulties and high maintenance costs associated with convention roadbed installations. Its principal of operation relies on the fact that, even under the heaviest free-flowing traffic conditions (i.e., at capacity), the probability of a temporal overlap between any two wheel silhouettes produced by vehicles in different lanes is quite small—certainly much less than five percent for traffic consisting primarily of two-axle passenger cars. Therefore, under most conditions of interest, it is possible to detect unambiguously the number and time-of-arrival (and therefore velocities) of nearly all axles crossing any point along the highway.

Capacity as used above is defined as the maximum sustained rate of traffic flow that can be expected to pass a uniform section of freeway under prevailing roadway, traffic, and control conditions [Appendix A, Reference 3]. For ideal conditions (e.g., 12-foot minimum lane widths, 6-foot minimum shoulder and median clearance, good weather, and passenger cars only in the traffic stream), capacity averages about 2000 pcphpl (passenger cars per hour per lane) and corresponds to an average travel speed and vehicle density of 30 mph and 67 pcpmpl (passenger cars per mile per lane), respectively.

But as vehicle densities increase and freeway speeds slow, traffic typically passes from a state of uninterrupted, free-flowing motion to an unstable "stop-and-go" condition. In this state, the duration of all beam blockage events increase substantially, leading to a much greater probability of mutual blockage between wheel silhouettes. Detection error increase commensurately and eventually, will exceed some tolerable limit. At this point the system can be said to have reached its breakdown point. For any prototype design, it is essential to discover exactly at what combination of traffic conditions (e.g., flow rates, speeds, densities) breakdown occurs. Once the breakdown point has been identified, attempts should be made to reduce the detection error by testing various combinations of beam angles and separations. In this way a system design can emerge which is optimized to perform over the widest range of traffic conditions.

In this section I discuss the progress made toward an optimized system design during the LAD development. This work was performed exclusively by means of computer simulations of both the traffic flow and the detection algorithm. In the next section, I describe the model used to simulate the microscopic (resolved car-by-car) characteristics of a multilane stream of cars moving past a point along a freeway. The "traffic scripts" generated by this model are used as an input to a second model, which simulates the response of the LAD system to the passage of axles through the beam array and tests the detection algorithm. Use of this model for identifying the system breakdown point and optimization of the array geometry is discussed below.

TRAFFIC SIMULATIONS

Complete testing of the LAD system requires several realistic sets of input data in which the speeds and times-of-arrival of individual vehicles in each lane of a multilane highway are prescribed. These data sets should encompass the entire range of likely operating conditions, from uninterrupted low density traffic through stop-and-go conditions. Early in the efforts, attempts were made to locate and obtain such data. I found that data this finely resolved in space and time is not available for any traffic conditions, let alone for the full range of conditions needed for system design and optimization. Consequently, I was forced to use computer modeling to generate our own simulated traffic data.

NUMERICAL TRAFFIC MODEL

We model the microscopic passage of cars past a point using an adaptation of the Greenshields nonlinear traffic-following model [Appendix A, References 1 and 2]. This model is based on four simplifying assumptions.

(1) Traffic in each lane is strictly one dimensions, unidirectional and uncorrelated with traffic in any other lane;

(2) Traffic consists of a single vehicle type (dual-axle passenger cars);

(3) Vehicles do not change lanes; and (4) Speeds and accelerations are internally controlled and not affected by any external influence over the traffic stream.

In addition, the model incorporates two common sense notions of traffic kinematics:

(a) The sign of the acceleration of an individual car is directly proportional to its velocity relative to the car immediately ahead of it (i.e., whether it is catching up or lagging behind), and (b) The magnitude of the acceleration/deceleration is inversely proportional to the distance between the two vehicles.

For an arbitrary vehicle n within a traffic stream containing N cars, Greenshields model can be expressed:

$$\frac{dV_n(t)}{dt} = C[1 + a_m\delta_n]\frac{V_{n-1}(t-\tau) - V_n(t-\tau)}{X_{n-1}(t-\tau) - X_n(t-\tau)} \quad (1)$$

where $X_n$ and $V_n$ denote the position (tagged to the front bumper) and velocity, respectively, of the vehicle at time t; $\tau$=0.4 sec is a small time increment assumed representative of the reaction time of a typical freeway driver; C and am are adjustable parameters; and $\delta_n$ is a normal-distributed random deviate with zero means and unit variance. Here we have ordered the cars such that $X_{n-1}>X_n$—i.e., Car #1 is furthest downstream in the traffic stream, followed by Car #2, etc.

Equation (1) contains two empirical parameters which must be specified. The first parameter C, which has units of velocity, is a global constant chosen to give the correct relationship between speed and density when the traffic statistics are averaged over space and time. Following Appendix A, Reference 2, I chose C to be equivalent to the mean traffic speed at capacity. Thus, for ideal four-lane freeway conditions, I set C=30 mph [Reference 3]. The second parameter, $a_m$, is a small lane-specific adjustment factor which, when multiplied by the Gaussain deviate $\delta_n$ and the global constant C, approximates in a crude way the distribution of engine powers and drivers' styles typical of individual cars in each lane m on a freeway. For the simulations reported here, I choose $a_m$=(0.20, 0.15, 0.10, 0.05) for m=1,2,3, and 4, respectively, where Lane 1 is assumed to lie adjacent to the shoulder (the "slow" lane) and Lane 4 is next to the median (the "fast" lane).

SIMULATION TECHNIQUE

Figure 8:
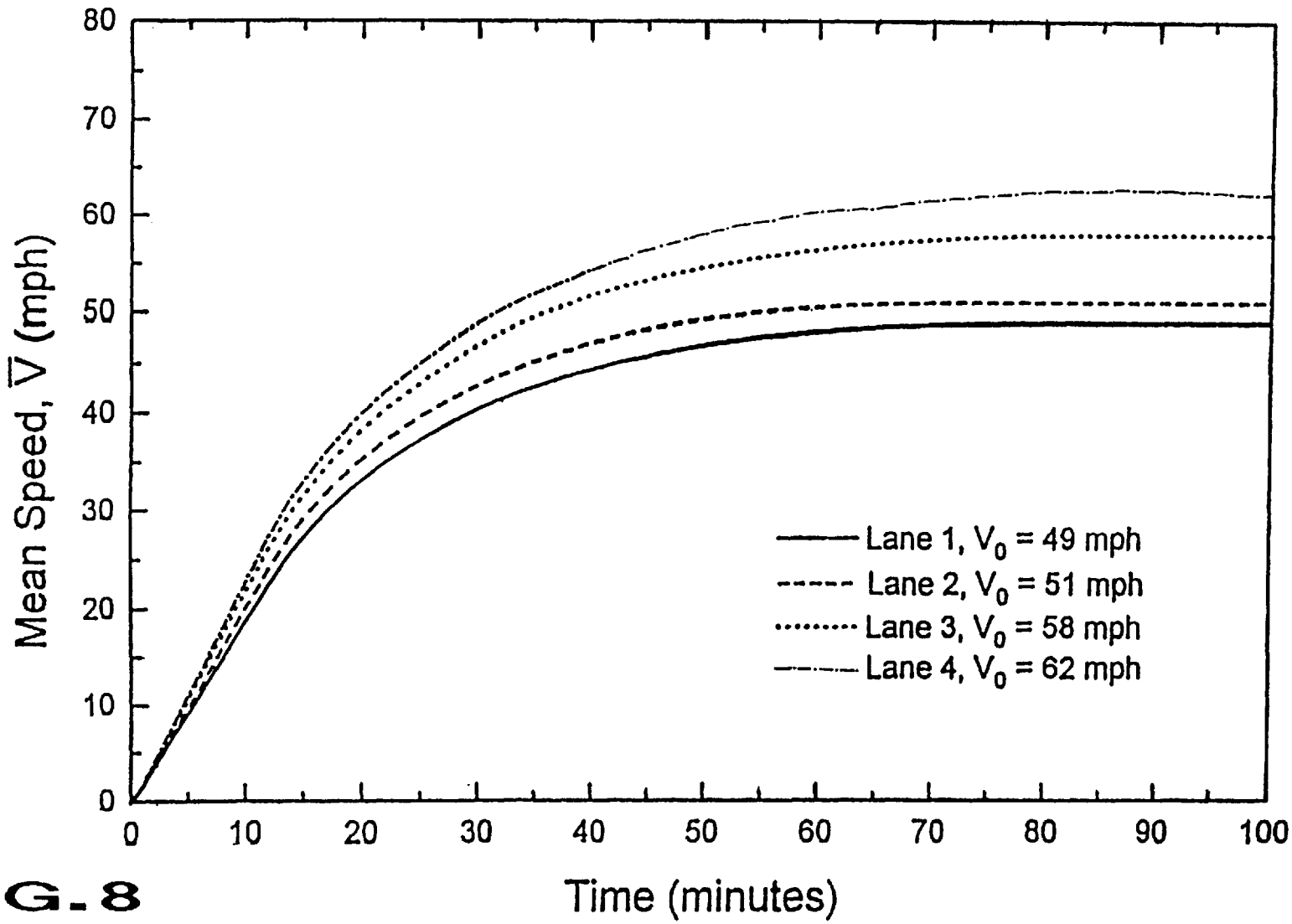
FIG. 8 is a time vs. speed graphical representation of asymptotic approach to equilibrium for a four lane highway simulation with 1000 cars per lane.

I apply Equation (1) to each of the N vehicles in Lane m with $\delta_n$ chosen at t=0 and held fixed throughout the simulation. The model therefore takes the form of N coupled differential equations with variable coefficients. "Forcing" is provided by a fictitious pace car at the head of the queue ("Car #0"), whose velocity $V_0$ is externally prescribed as a function of time independent of Eq. (1). Early experiments with this model found that by prescribing a time-varying $V_0$, a wide variety of realistic traffic behaviors could be produced upstream (i.e., for n≦1), including local density rarefaction and compressions, queuing motion, and traffic "waves" which propagate upstream at a phase speed controlled by the reaction time $\tau$. To generate statistics for system design and optimization, however, a much simpler scenario was devised in which the pace car is assumed to travel at a time-invariant $V_0$ representative of all cars in Lane m. Each vehicle behind the pace car, starting from rest and initially arrayed bumper-to-bumper, then develops its own "natural" acceleration and speed based on Eq. (1) as it follows along. For these simulations, we use N=1000 cars per lane and integrate Eq. (1) with a 0.01-sec. time step using a first-order, time-forward (Euler) marching scheme to obtain updated velocities $V_{n,m}$. These velocities are then integrated once more to arrive the updated vehicle positions $X_{n,m}$. Integration proceeds until the mean travel speed (integrated over all N cars) has asymptotically converged to the pace car speed $V_0$ as illustrated in FIG. 8. The time-or-arrival for each car at an arbitrary point far downstream from the start of the queue (X=0, the starting position of the pace car) is then recorded, and the resultant "traffic scripts" used for system testing of specific system geometries.

TABLE 2

Sample traffic simulation script (extract) for $V_0$ = 49 mph at X – 70 miles.

| Car n | Time of Arrival HH:MM:SS | Speed, $V_a$ (mph) | Gap, $G_a$ (VL) | Headway $H_a$ (sec) | Lateral Displacement $Y_a$ (ft) |
|---|---|---|---|---|---|
| 1 | 1:26:17.90372 | 49.0 | 2.393 | 2.205 | 1.164 |
| 2 | 1:26:19.53502 | 49.0 | 8.907 | 1.631 | 0.125 |
| 3 | 1:26:22.36237 | 49.0 | 16.171 | 2.827 | 1.814 |
| 4 | 1:26:24.43530 | 49.0 | 11.589 | 2.073 | −0.046 |
| 5 | 1:26:27.40623 | 49.0 | 17.043 | 2.971 | −0.273 |
| 6 | 1:26:32.17946 | 49.0 | 27.989 | 4.773 | 0.228 |
| 7 | 1:26:34.97256 | 49.0 | 15.963 | 2.793 | 0.683 |
| 8 | 1:26:36.13024 | 49.0 | 6.031 | 1.158 | −2.206 |
| 9 | 1:26:38.19063 | 49.0 | 11.513 | 2.060 | 2.323 |
| 10 | 1:26:39.55090 | 49.0 | 7.261 | 1.360 | −0.633 |
| 11 | 1:26:41.04116 | 49.0 | 8.051 | 1.490 | −0.650 |
| 12 | 1:26:43.49230 | 49.0 | 13.886 | 2.451 | −1.402 |
| 13 | 1:26:45.54862 | 49.0 | 11.489 | 2.056 | 0.431 |
| 14 | 1:26:46.90783 | 49.0 | 7.255 | 1.359 | −0.658 |
| 15 | 1:26:48.47640 | 49.0 | 8.526 | 1.569 | 1.162 |
| 16 | 1:26:50.89148 | 49.0 | 13.667 | 2.415 | −0.344 |
| 17 | 1:26:53.36594 | 49.0 | 14.028 | 2.474 | −0.277 |
| 18 | 1:26:55.39531 | 49.0 | 11.325 | 2.029 | 0.499 |
| 19 | 1:26:57.79254 | 49.0 | 13.559 | 2.397 | −0.012 |
| 20 | 1:26:59.51567 | 49.0 | 9.465 | 1.723 | −0.689 |
| 21 | 1:27:0.98029 | 49.0 | 7.895 | 1.465 | −1.618 |
| 22 | 1:27:2.74821 | 49.0 | 9.737 | 1.768 | −0.290 |
| 23 | 1:27:4.89985 | 49.0 | 12.067 | 2.152 | −0.002 |
| 24 | 1:27:6.48561 | 49.0 | 8.631 | 1.586 | −0.461 |
| 25 | 1:27:8.09371 | 49.0 | 8.766 | 1.608 | 0.191 |
| 26 | 1:27:9.93477 | 49.0 | 10.181 | 1.841 | 2.931 |
| 27 | 1:27:11.59166 | 49.0 | 9.063 | 1.657 | 1.288 |
| 28 | 1:27:14.19472 | 49.0 | 14.809 | 2.603 | −0.249 |
| 29 | 1:27:19.62633 | 49.0 | 31.987 | 5.432 | −0.632 |
| 30 | 1:27:22.47397 | 49.0 | 16.294 | 2.848 | −1.967 |
| 31 | 1:27:23.89006 | 49.0 | 7.600 | 1.416 | −0.596 |
| 32 | 1:27:25.83442 | 49.0 | 10.809 | 1.944 | −1.035 |
| 33 | 1:27:27.00127 | 49.0 | 6.087 | 1.167 | 1.508 |
| 34 | 1:27:28.52281 | 49.0 | 8.241 | 1.522 | 1.476 |
| 35 | 1:27:30.38873 | 49.0 | 10.332 | 1.866 | 2.175 |
| 36 | 1:27:33.27832 | 49.0 | 16.549 | 2.890 | 1.559 |
| 37 | 1:27:35.37633 | 49.0 | 11.742 | 2.098 | −0.531 |
| 35 | 1:27:39.20492 | 49.0 | 22.252 | 3.829 | 1.025 |
| 39 | 1:27:41.73035 | 49.0 | 14.338 | 2.525 | 1.035 |
| 40 | 1:27:44.12568 | 49.0 | 13.547 | 2.395 | −0.186 |
| 41 | 1:27:46.71474 | 49.0 | 14.724 | 2.589 | −1.001 |
| 42 | 1:27:48.29792 | 49.0 | 8.615 | 1.583 | 0.175 |
| 43 | 1:27:50.07155 | 49.0 | 9.772 | 1.774 | −0.754 |
| 44 | 1:27:52.15063 | 49.0 | 11.627 | 2.079 | 0.355 |
| 45 | 1:27:54.22422 | 49.0 | 11.593 | 2.074 | −0.415 |
| 46 | 1:27:56.79839 | 49.0 | 14.634 | 2.574 | −0.408 |
| 47 | 1:27:58.46169 | 49.0 | 9.102 | 1.663 | −0.304 |
| 48 | 1:27:59.73991 | 49.0 | 6.763 | 1.278 | −3.043 |
| 49 | 1:28:1.64573 | 49.0 | 10.575 | 1.906 | −0.847 |
| 50 | 1:28:3.95073 | 49.0 | 12.999 | 2.305 | 0.142 |
| 51 | 1:28:6.13769 | 49.0 | 12.282 | 2.187 | 0.598 |
| 52 | 1:28:8.64947 | 49.0 | 14.255 | 2.512 | 1.718 |

TABLE 2-continued

Sample traffic simulation script (extract) for $V_0$ = 49 mph at X – 70 miles.

| Car n | Time of Arrival HH:MM:SS | Speed, $V_a$ (mph) | Gap, $G_a$ (VL) | Headway $H_a$ (sec) | Lateral Displacement $Y_a$ (ft) |
|---|---|---|---|---|---|
| 53 | 1:28:14.74414 | 49.0 | 36.014 | 6.095 | −0.079 |
| 54 | 1:28:18.13578 | 49.0 | 19.598 | 3.392 | 0.154 |
| 55 | 1:28:19.98798 | 49.0 | 10.249 | 1.852 | −2.146 |
| 56 | 1:28:24.79780 | 49.0 | 28.211 | 4.810 | 1.378 |
| 57 | 1:28:26.98760 | 49.0 | 12.299 | 2.190 | 1.439 |
| 58 | 1:28:30.97853 | 49.0 | 23.238 | 3.991 | 0.407 |
| 59 | 1:28:32.30897 | 49.0 | 7.080 | 1.330 | −0.044 |
| 60 | 1:28:33.76362 | 49.0 | 7.834 | 1.455 | 1.972 |
| 61 | 1:28:34.98516 | 49.0 | 6.419 | 1.222 | −0.957 |
| 62 | 1:28:36.76223 | 49.0 | 9.793 | 1.777 | 1.176 |
| 63 | 1:28:38.04659 | 49.0 | 6.800 | 1.284 | 2.089 |
| 64 | 1:28:40.83151 | 49.0 | 15.913 | 2.785 | −0.248 |
| 65 | 1:28:57.63059 | 49.0 | 101.025 | 16.799 | −1.327 |
| 66 | 1:28:59.58427 | 49.0 | 10.865 | 1.954 | 2.624 |

SIMULATION RESULTS: HEADWAY AND GAP

Table 2 shows a portion typical script for a single traffic lane and forcing velocity. Note that even through the velocities of each car are the same, the headway and gap between each varies.

The gap $G_n$ associated with vehicle n is defined $G_n=X_{n-1}-X_n-L$, where L is the end-to-end vehicle length (assumed the same for all n). The headway $H_n$ is a temporal interval between successive front bumper passages at a fixed point; it is defined $H_n=(Xn-1=X_n)/V_n$.

This variation is a direct consequence of the random function $\delta_n$ incorporated into Eq. (1). Indeed, if I have set $\delta_n=0$ for all n (or, equivalently, set $a_m=0$) I would have obtained a uniform gap and headway in the asymptotic limit. The fact that the gap and headway are not uniform is similar to the situation found in real traffic, where spacings between cars can vary widely, reflecting the opinions of different drivers regarding "safe" following distances. In reality, some of this variation would disappear over time as cars changed lanes or exited the freeway—a mechanism not modeled in my simulations. But we nevertheless find that our simulated distributions of headway to qualitatively mimic real traffic, as illustrated in FIG. 9. In particular, we find that prescribing a relatively large dispersion of accelerations in the slow lane ($a_1$=0.20), we can reproduce the positive skew in the headway probability distribution characteristic of real traffic, for example, on the Long Island Expressway as reported in Appendix A, Reference 1, DOT, 1985 and shown FIG. 9*b*. This asymmetry presumably results from the fact that, at any given time, a large fraction of the cars in the slow lane are either decelerating in preparation for exiting the freeway or speeding up in order to merge into the traffic stream. On the other hand, cars in the fast lane (m=4), tend to be traveling more or less at their cruising speed and so have a smaller range of accelerations ($a_4$=0.05—a fact captured by the more symmetric probability distribution both in the simulation, FIG. 9*a* and in the available data, FIG. 9*b*.

SIMULATION RESULTS: LATERAL DISPLACEMENT

Figure 10:
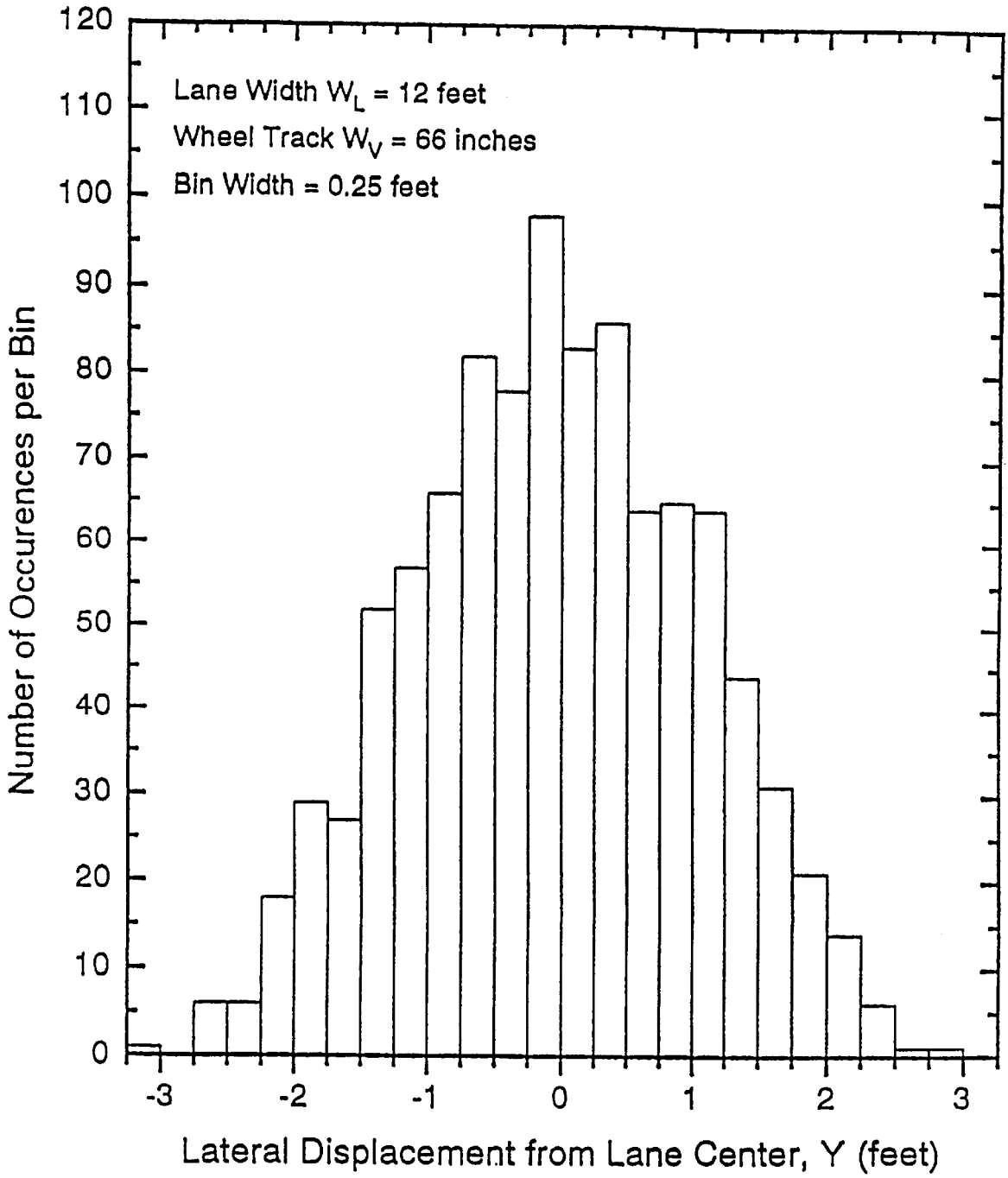
FIG. 10 is a graphical representation of simulated lateral vehicle displacement within lanes for N=1000 simulation.

Another key simulation variable is the lateral (i.e., perpendicular to traffic) position of each car within its lane. We assume that every car in the simulation is identical, with a wheel track (the lateral spacing between wheels) $W_V$=66 inches (5.5 feet). Therefore, within the assumed standard lane width $W_L$=12 feet, the centerline of each car can be displaced as much as Y=±(12–5.5)/2=±3.25 feet to the left or right of the lane centerline. Such displacements can vary the timing of the beam blockages as the cars pass through the LAD beam array and therefore must be modeled. The approach is to assume that the centerline position $Y_n$ of each vehicle as it enters the array is randomly distributed with a symmetric Beta probability distribution of the form:

$$P(Y_n) = \frac{1}{(Y_{max}-Y_{min})}\frac{\Gamma(12)}{\Gamma(6)\Gamma(6)}\left(\frac{Y_n-Y_{min}}{Y_{max}-Y_{min}}\right)^5\left[1-\frac{Y_n-Y_{min}}{Y_{max}-Y_{min}}\right]^5, \quad (2)$$

where Γ(x) is the gamma function and $Y_{max}$ and $Y_{min}$ are +3.25 and −3.25 feet, respectively. This distribution guarantees that the most likely displacement of any car is zero, with a small but nonzero probability that the displacement is as much ad 3.25-feet off-center, but zero probability that the tires on either side of the car across the lane boundary. Values for $Y_n$ are recorded as part of the simulation scripts, as indicated by the last column in Table 2. A plot of a sample distribution for N=1000 is shown in FIG. 10.

SIMULATION RESULTS: SPEED, DENSITY AND FLOW RATES

Figure 11A:
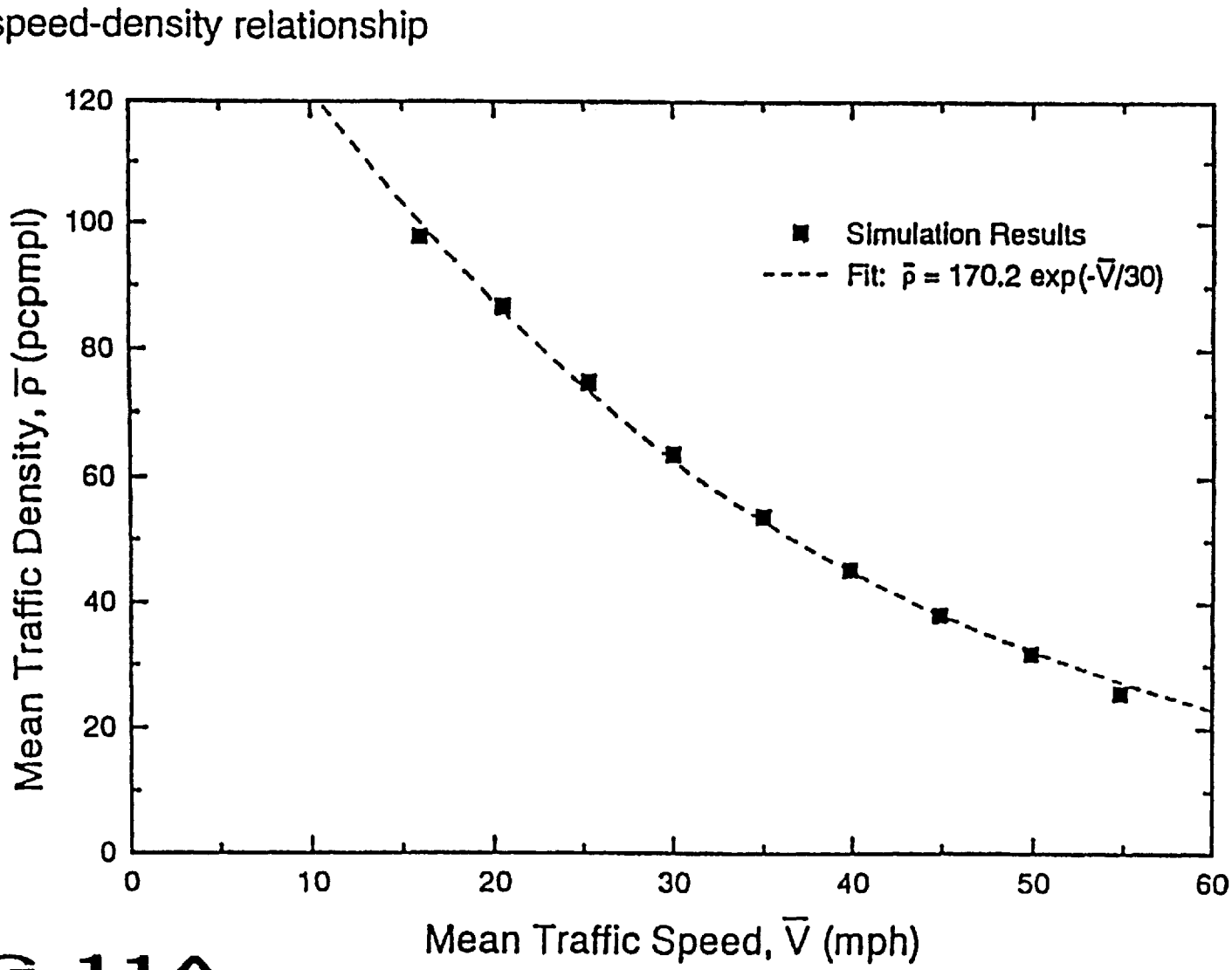
FIG. 11 comprises a pair of graphical representations of (a) mean traffic density vs mean traffic speed and (b) traffic flow rate vs mean traffic speed for nine different scenarios.
Figure 11B:
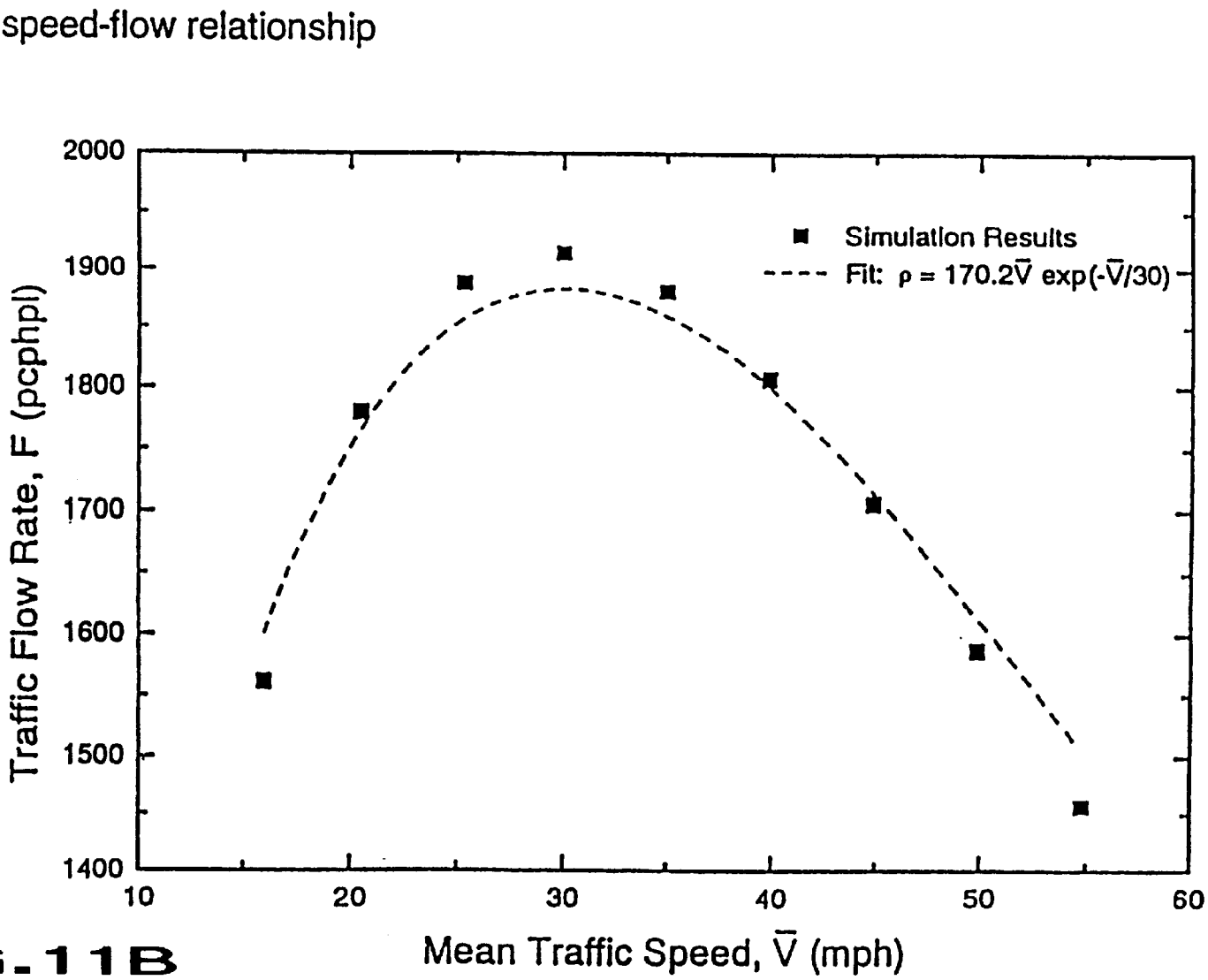

Traffic simulations were completed for nine distinct cases: A baseline case, meant to simulate free-flow conditions on a real four-lane freeway; and eight variants with in which the speed in is each lane is reduced in successive 5-mpg increments. The input parameters for each of these cases, as well as the resultant average speeds, traffic densities, and flow rates are listed in Table 3. Here we have computed the averages much as one would do real traffic—i.e., by counting the total number of cars in all lanes (and recording their speeds) which pass a point during a 15-minute interval, then averaging over space and time and expressing the results on a per-hour and per-lane basis. These results indicate that, while the density increases monotonically with a decrease in traffic speed, FIG. 11*a*, the flow rate maximizes at 1914 pcphpl (96 percent of capacity) at an intermediate speed around $\overline{V}$=30 mph, as illustrated in FIG. 11*b*. This behavior is consistent with the concept of capacity flow [e.g., Appendix A, Reference 1, DOT, 1985], and is an indication that our model is providing a credible simulation of traffic flow over a fairly wide range of conditions.

SYSTEM DESIGN OPTIMIZATION STUDIES

As explained above, the LAD system consists of two distinct components: The Velocity Beam Array (VBA), and the Lane Discriminator Array (LDA). Each of these components involves a separate layout of beams and detectors whose configuration must be optimized over a wide range of simulated traffic conditions.

PROTOTYPE VBA LAYOUT

Figure 12:
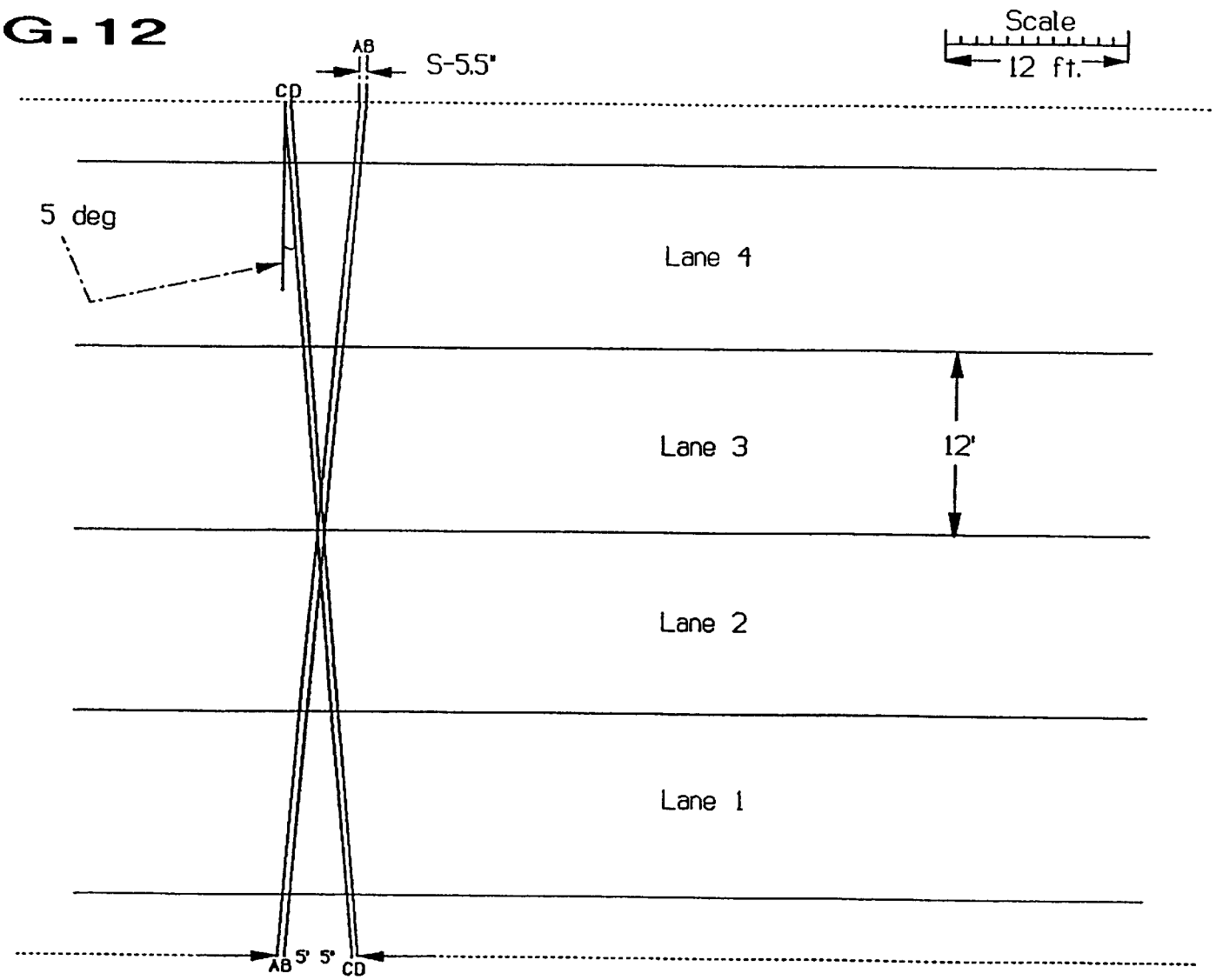
FIG. 12 is a layout of a four lane prototype sensor array.

The first task in exploring the optimal layout of the VBA was to determine the maximum traffic density at which a prototype design could perform within the acceptable error range. For this effort I chose a configuration similar to the four-beam layout described above in connection with FIG. 1. A "double X" design consisting of two sets of parallel beam pairs separated by a distance s and set at an angle θ with respect to cross-traffic direction, but with zero separation between the pairs (d=0). I further set, more or less arbitrarily, θ=5° and s=5.5 inches—equivalent to one-fourth the assumed diameter of standard passenger car tire. A scaled drawing of the prototype design deployed on a four-lane highway is shown in FIG. 12.

SYSTEM RESPONSE MODELING

A key elements in the optimization studies is the system response mode. Using the vehicle time-of-arrival scripts generated by the simulation model and the input parameters θ, s, and d, this model determines, whether or not the wheel of any car is within the line of sight of each beam at any given instant. Here we assume that the beam is blocked if it intersects any portion of a segment equal to the assumed tire diameter $D_w$=22 inches. Thus we effectively assume that the tires are rectangular (a worst case assumption) and do not consider the possibility of beam passage around their circular profiles.

Figure 13:
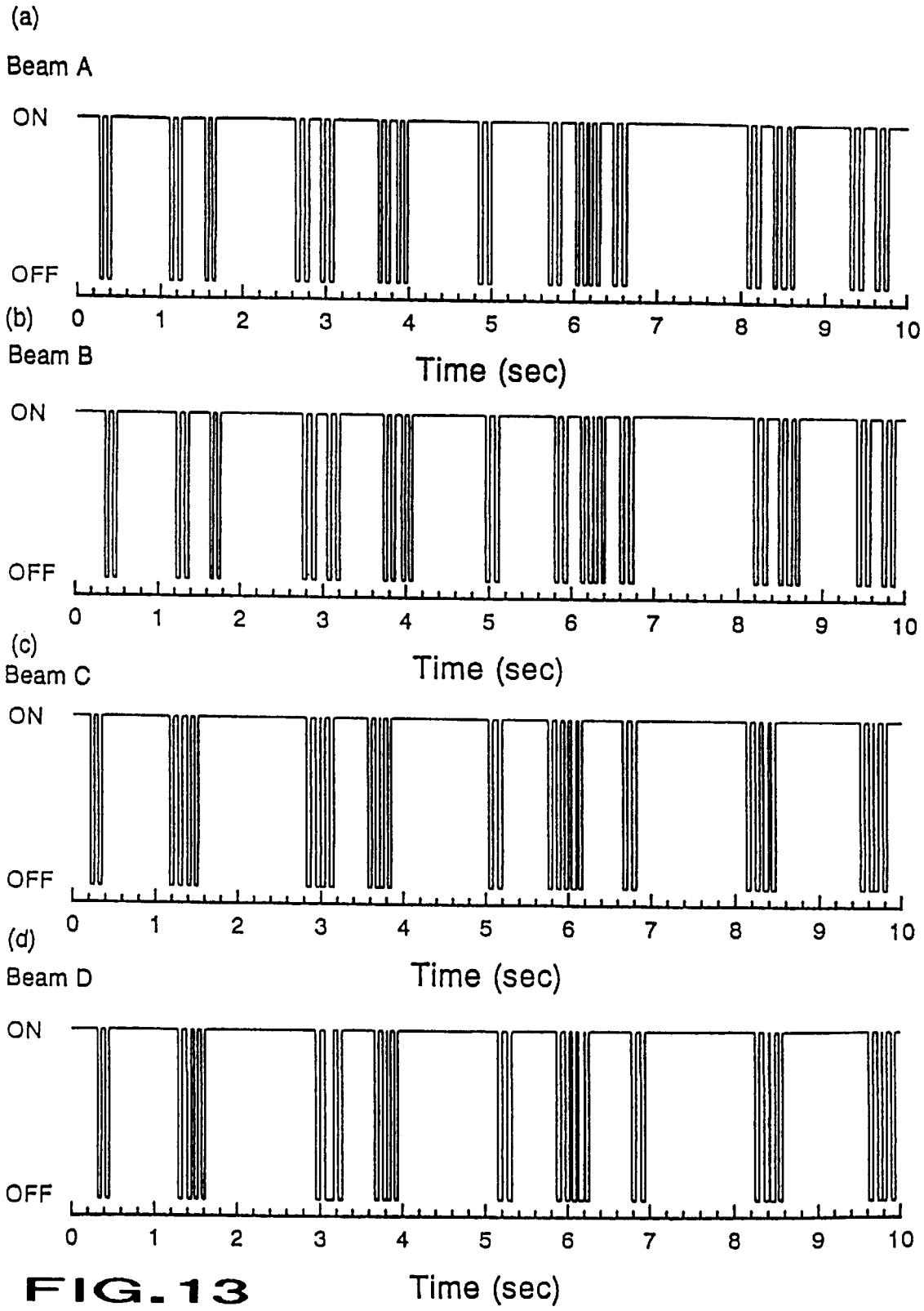
FIG. 13 is a simulated wave form display of 10 second beam responses for the prototype array of FIG. 12.

FIG. 13 illustrates the operation of the response model for the prototype VBA design and the baseline (Case 1) traffic conditions. Like the Tabletop Demonstrator Model discussed below in connection with FIGS. 16–20, we assume that the response is binary—i.e., the detected signal is either ON or OFF. As a result, as traffic passes in front of the beams, an irregular sequence of pulses is recorded. When single cars pass through the array, these pulses appear as doublets corresponding to the passage of first the front pair and then the rear pair of wheels. (Clear lines of sight between left and right wheels is not possible for passenger cars provided θ is less than about 23°.) In this case the velocity of the vehicle can be easily determined, for example, from the difference between the timings of the ON/OFF transitions at Beams A and B or Beams C and D. In general, however, more than one cars may be in the array at any given moment. In these situations (for example, around the 8.5-sec. mark in FIG. 13), the pulse doublets may occur very close together in time or even overlap, making vehicle detection and speed estimation difficult. These are the situations which can lead to errors and must be mitigated by optimization.

BREAKDOWN DENSITY DETERMINATION

The prototype VBA design shown in FIG. 12 was tested against each of the nine traffic scenarios listed in Table 3.

TABLE 3

Traffic simulation cases.

| CASE | Prescribed Vehicle Speeds, $V_0$ (mph) Lane 1 | Lane 2 | Lane 3 | Lane 4 | Mean Speed $\bar{V}$ (mph) | Mean Density $\bar{\rho}$ (pcpmpl) | Mean Flow $\bar{F}$ (pcphpl) |
|---|---|---|---|---|---|---|---|
| 1[a] | 49 | 51 | 58 | 62 | 54.8 | 25.6 | 1457 |
| 2 | 44 | 46 | 53 | 57 | 49.9 | 31.8 | 1587 |
| 3 | 39 | 41 | 48 | 52 | 44.9 | 38.0 | 1706 |
| 4 | 34 | 36 | 43 | 47 | 39.9 | 45.2 | 1807 |
| 5 | 29 | 31 | 38 | 42 | 35.0 | 53.7 | 1881 |
| 6 | 24 | 26 | 33 | 37 | 30.0 | 63.6 | 1914 |
| 7 | 19 | 21 | 28 | 32 | 25.3 | 74.7 | 1888 |
| 8 | 14 | 16 | 23 | 27 | 20.5 | 86.7 | 1780 |
| 9 | 9 | 11 | 18 | 22 | 16.0 | 97.7 | 1561 |

[a]Baseline case: Highway I-8, San Diego, CA [DOT, 1985]

For each test, a total of twelve simulations were carried out, each consisting of a five-minute sequence of traffic. Each traffic sequence was generated in such a way as to be independent of the others by randomly perturbing the starting time of the traffic scripts for each lane. In this way we effectively introduced a random phase shift between each lane, while still maintaining the same combination of traffic speed and density.

For each simulated axle crossing, we rated the VBA response as either a success or a failure. Success was declared only if both of the following conditions were met:

(1) A distinct ON/OFF or OFF/ON transition was detected at both Beam A and B or Beams C and D (condition of minimal overlap), and (2) The estimated velocity associated with each axle crossing was within ±5% of the true velocity as recorded on the input traffic script (condition of minimal overtaking).

Note that according to this definition, a success was scored if one of the VBA pairs detected a distinct axle passage. But if neither of the beam pairs recorded a successful detection, a failure was scored.

Figure 14:
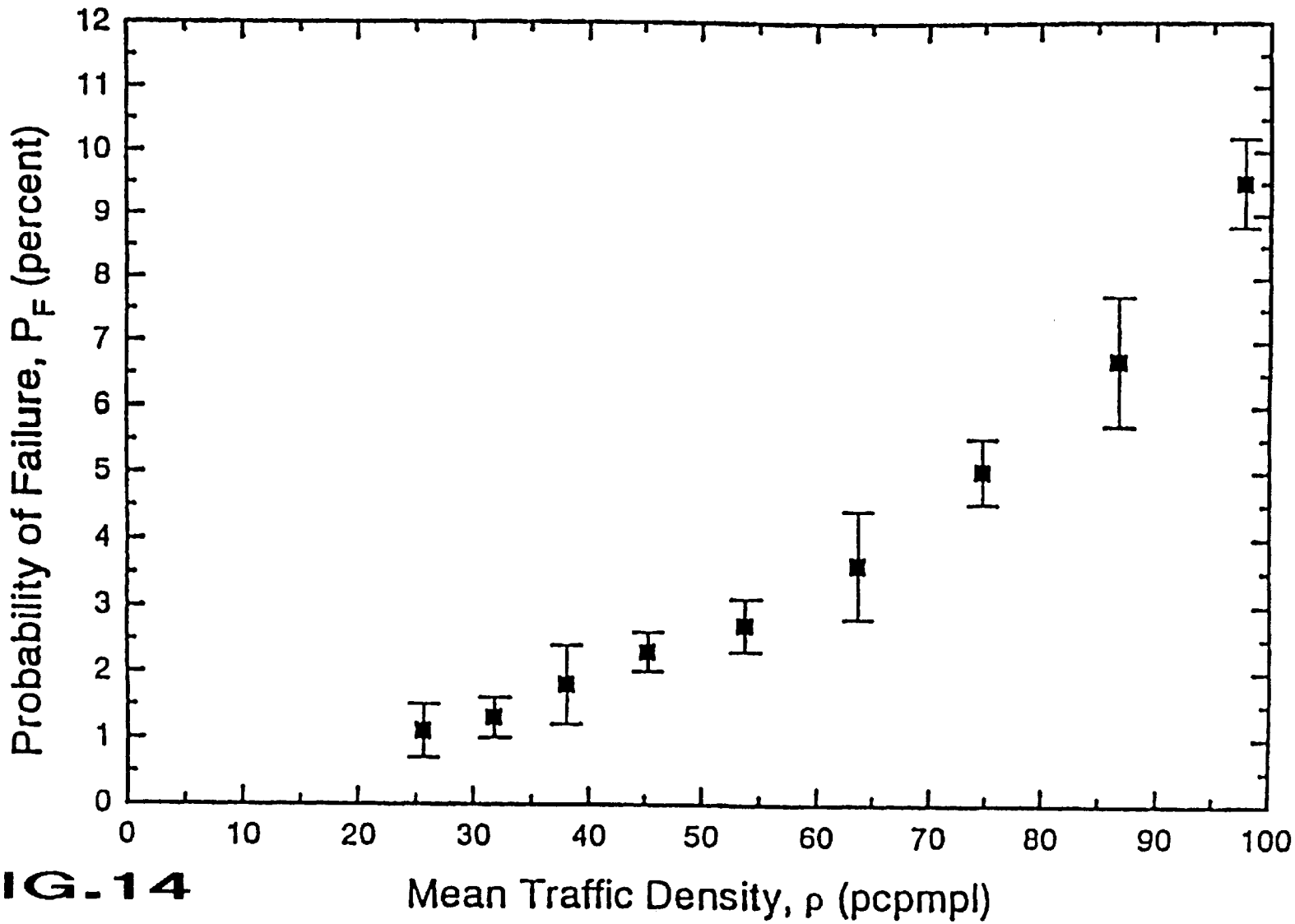
FIG. 14 is a graphical display of failure probability vs mean traffic density.

FIG. 14 shows the estimated probability of failure PF for the prototype VBA design as a function of mean traffic density determined by applying the scoring method to the nine traffic simulation cases listed in Table 2. I find that at relatively low density (free-flowing) four lane traffic, this design performs quite well. Indeed, for the baseline traffic case (Case 1), I find that the system detects and correctly estimates the speed in excess of 99 percent of the time. But as traffic builds and densities increase, FIG. 14 shows that system performance gradually degrades, eventually reaching its breakdown point (arbitrarily defined as PF ≦5%) at about $\bar{\rho}$=75 pcpmpl (Case 7 in Table 3). Referring back to FIG. 11*b*, I see that this breakdown density lies beyond the peak in the simulated flow rate curve. Therefore, even without attempting to optimize the parameters θ, s, and d, I find that the VBA performs within the specified margin of error for all free-flowing traffic situations and only begins to break down as stop-and-go conditions develop. Note that I would expect much better performance for 3 or fewer lanes (100 percent accuracy is predicted for all cases of one lane traffic.)

VBA PARAMETER OPTIMIZATION

Figure 15A:
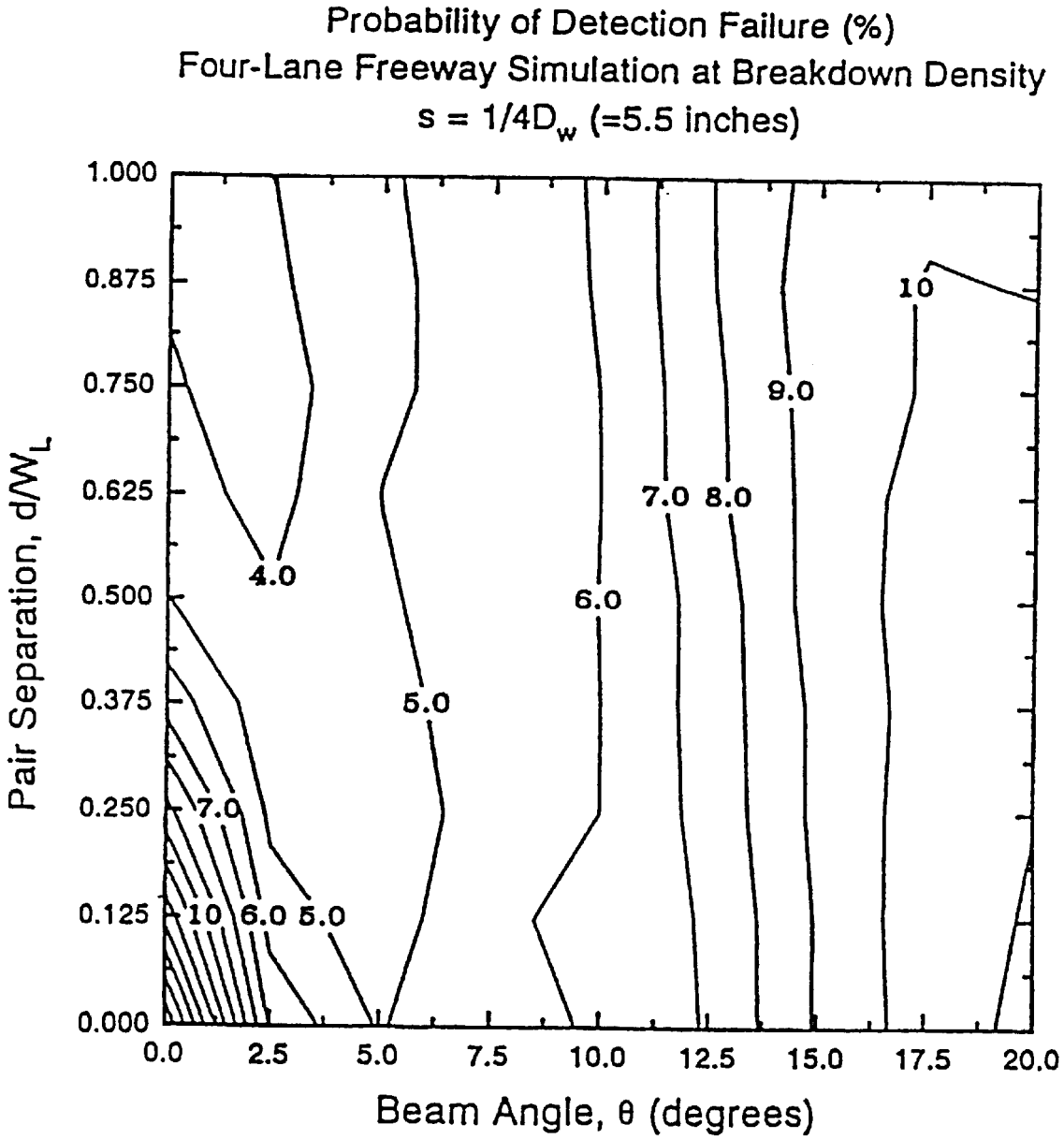
FIG. 15 comprises a pair of graphical representations of failure as a function of beam angle at two different beam separations.
Figure 15B:
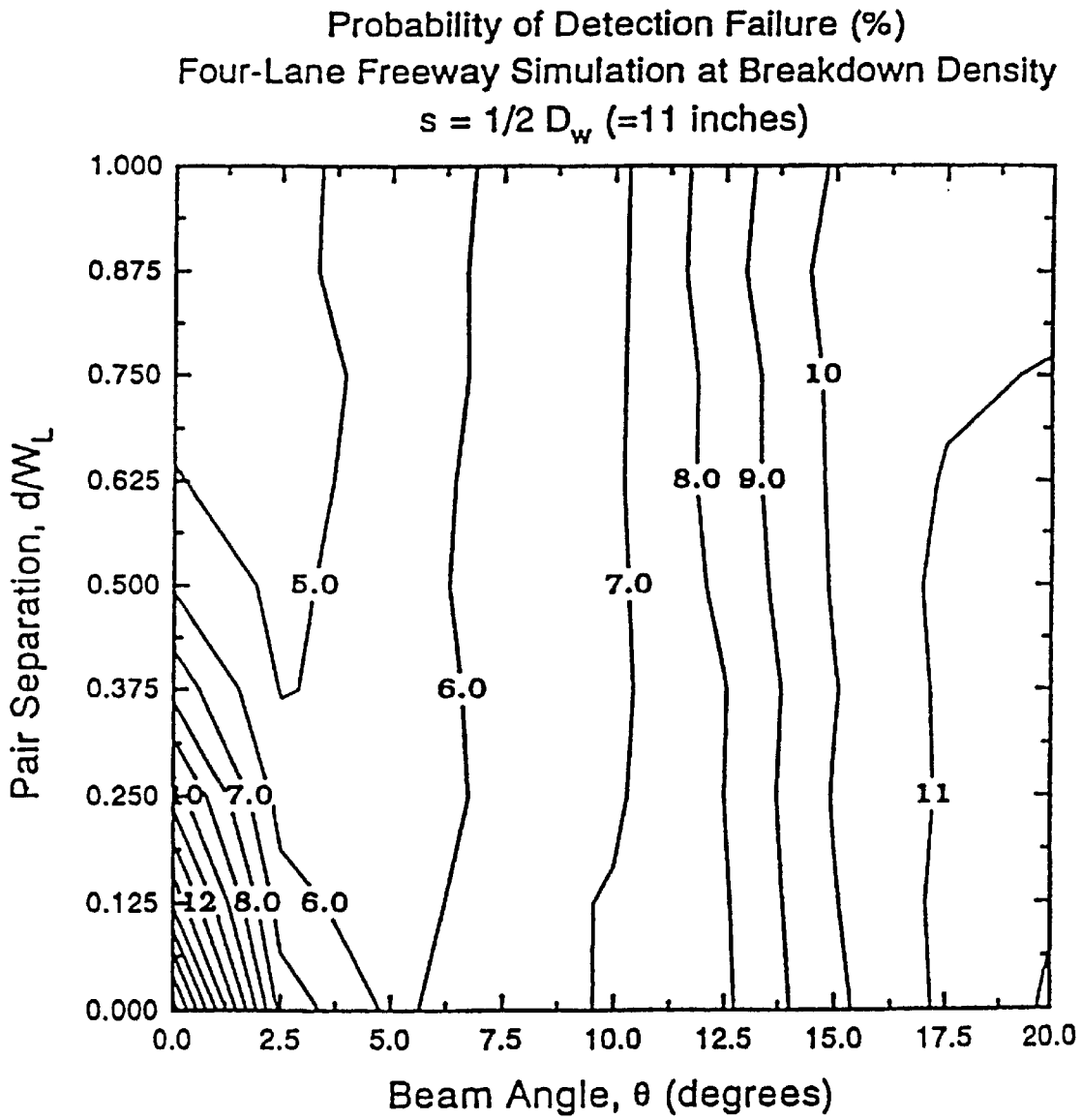
Figure 16:
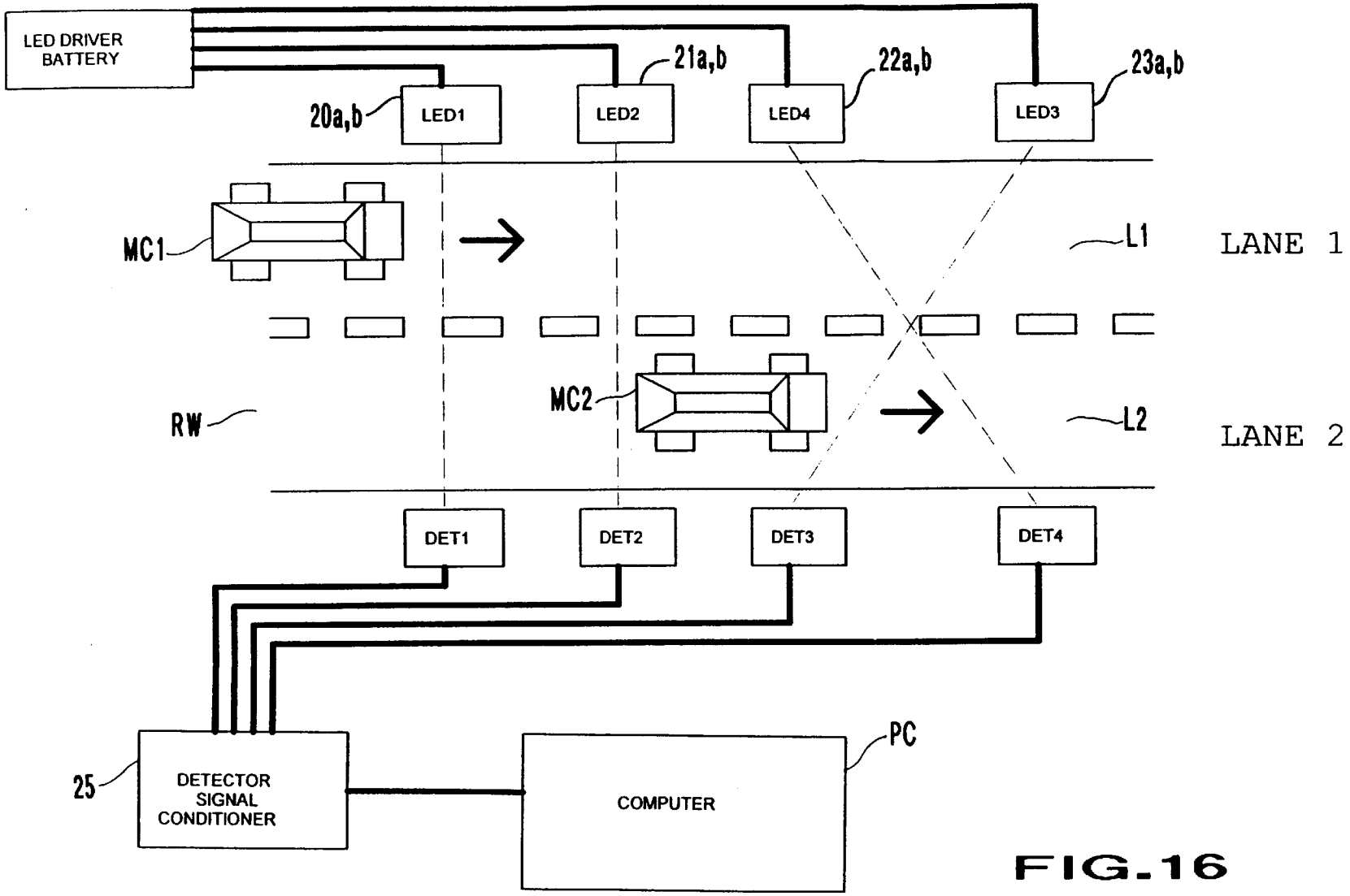
FIG. 16 is a simplified block diagram of an axle counter demonstrated layout.

In order to determine the optimum combination of parameters for the VBA design, I performed an additional series of simulations for traffic scenario Case 7. In these simulations, I held the interbeam spacing fixed, while independently varying the beam angle between θ=0 (perpendicular beam) and θ=20° and the separation distance d between 0 (the X-configuration) and d=WL (=12 feet, the standard lane width). The resultant variation in probability of failure detection PF is shown in FIG. 15 for two values of the interbeam spacing S. These results indicate that the best layout for the VBA—at least from the standpoint of minimal detection error—is to either place the beams in an X-configuration (d=0) at θ≈5° (i.e., the prototype design), or to widely separate the beams by 12 feet or more and have them traverse the roadway perpendicular to traffic (θ=0). In either case, a probability of failure in the vicinity of the breakdown threshold PF=5% can be expected, although these results could change if realistic variations in wheel diameter, vehicle types, accelerations, etc. were accounted for.

BREADBOARD DEMONSTRATION MODEL

Description of Model

A table-top demonstration model breadboard was fabricated to illustrate the principles involved in LAD. This demonstrates 1/18 model cars MC1 and MC2 on a two lane highway. There are four pairs of AlGaAs Infrared Light Emitting Diodes 20*a,b*–23*a,b* and Silicon Photodetectors 24*a,b*–27*a,b* in the arrangement of to FIG. 16. Two pairs 20*a,b* and 21*a,b* use a light beam perpendicular to the roadway RW. The other two pairs 22*a,b* and 23*a,b* cross at approximately a 45 degree angle intersection at the center stripe dividing the lanes L1 and L2. All four LED/Photodetector pairs 24*a,b*–27*a,b* are controlled by a signal conditioner 25 which in turn is controlled by a counter timer board which plugs into a standard PC computer. The model cars MC1 and MC2 (Mustang and Alpha Romero) are pushed by hand along the model two lane highway RW to interrupt the light beams. The signal is processed by the computer to generate data on:

Lane discrimination

Velocity Determination

Wheel Base Distribution

Lane Displacement.

Figure 17:
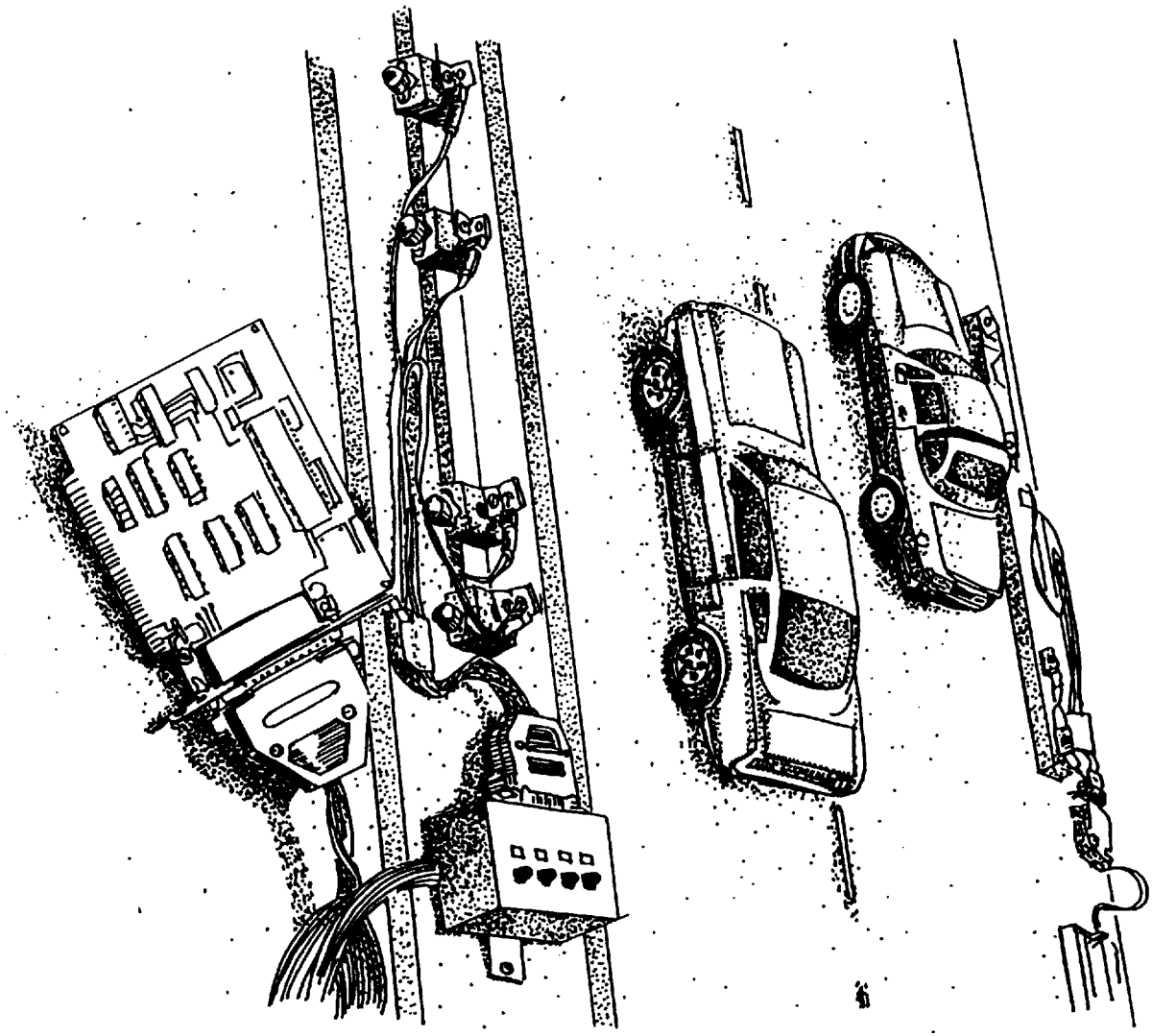
FIG. 17 is a photograph of the prototype demonstrated in FIG. 16.

A photograph of the Model is shown in FIG. 17.

Figures 18, 18A:
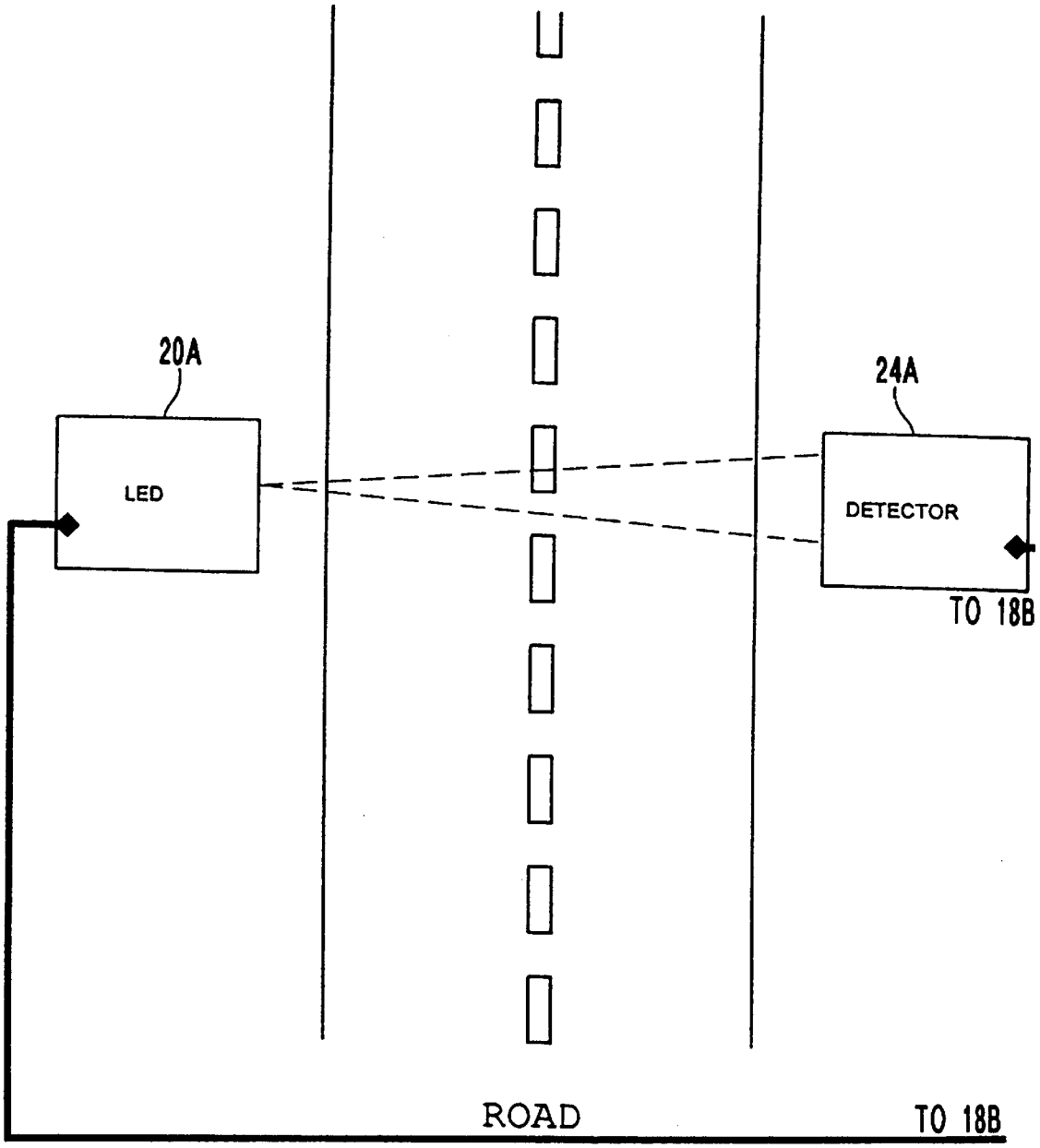
FIG. 18 is a block diagram of one emitter/detector channel of the prototype of FIGS. 16 and 17.
Figure 18B:
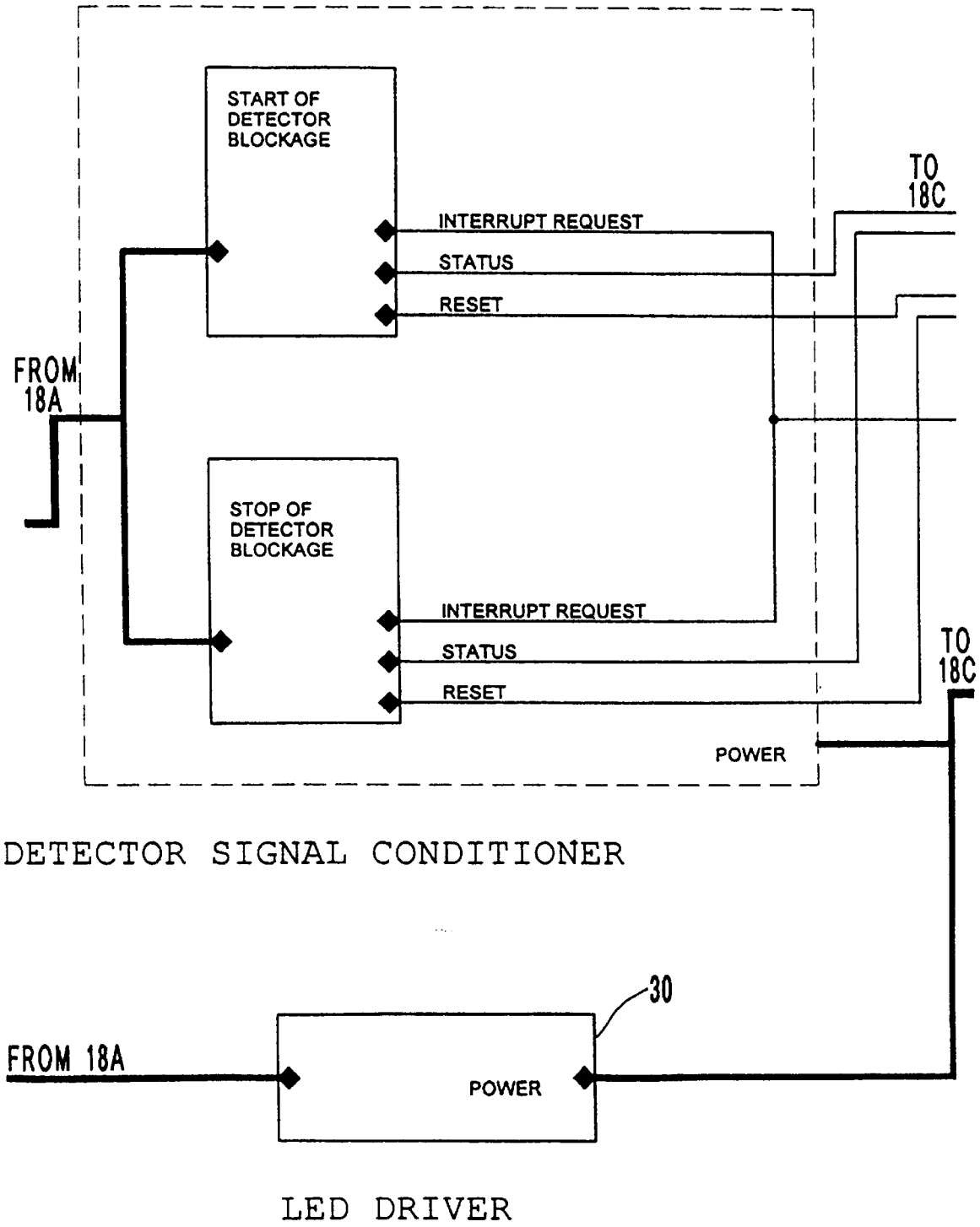
Figure 18C:
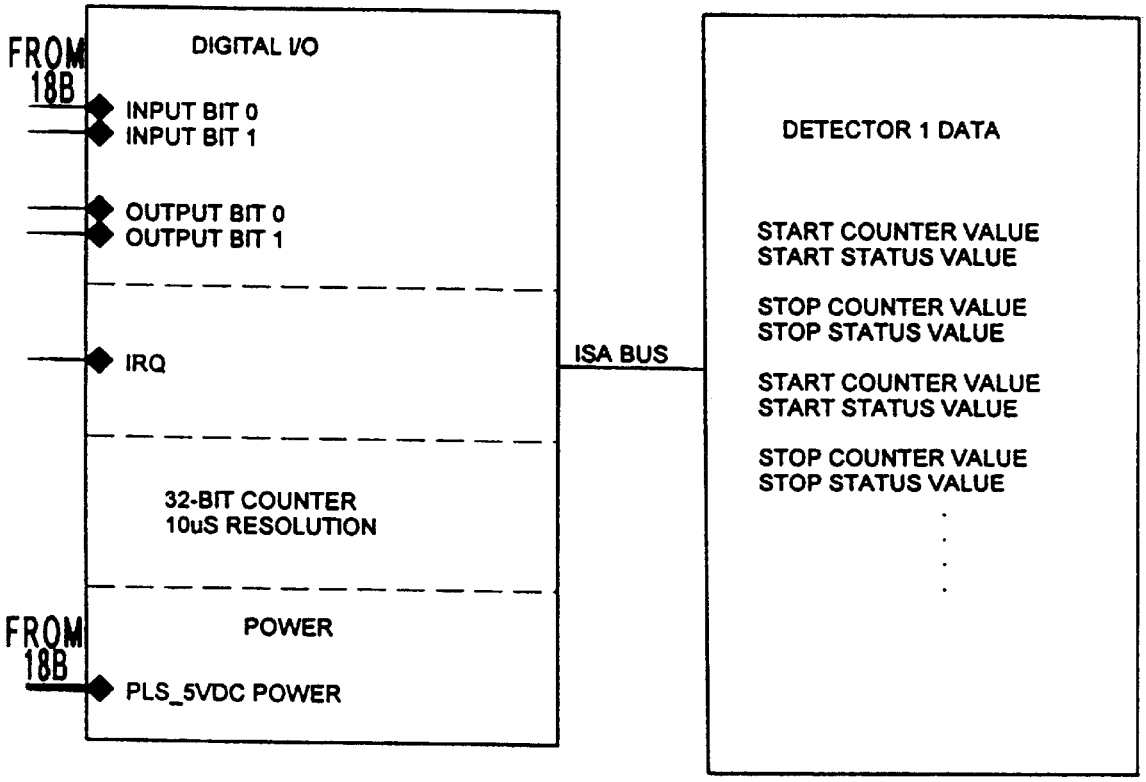

Referring now to FIG. 18, the circuitry of one channel is shown including the light source, e.g., LED 20*a* and a photo detector 24*a*. Power for the LED light source is supplied by its driver 30 and a conventional D.C. power supply. A separate or this same source may be used to supply power to a detector 31, 32 signal conditioner 34 and a PC adapter card 32 which provides signals over a bus 32 to a computer PC. When combined with the output of diodes 24*a,b*–27*a,b* of FIG. 1, the computer PC can provide the following data for the roadway monitored during the period monitored:

vehicles/hour on the roadway vehicles/per lane on the roadway vehicle velocity distribution/lane vehicle classification vehicle acceleration vehicle deceleration vehicle displacement from lane centerline when utilizing the program set forth in Table 3.

Figure 19A:
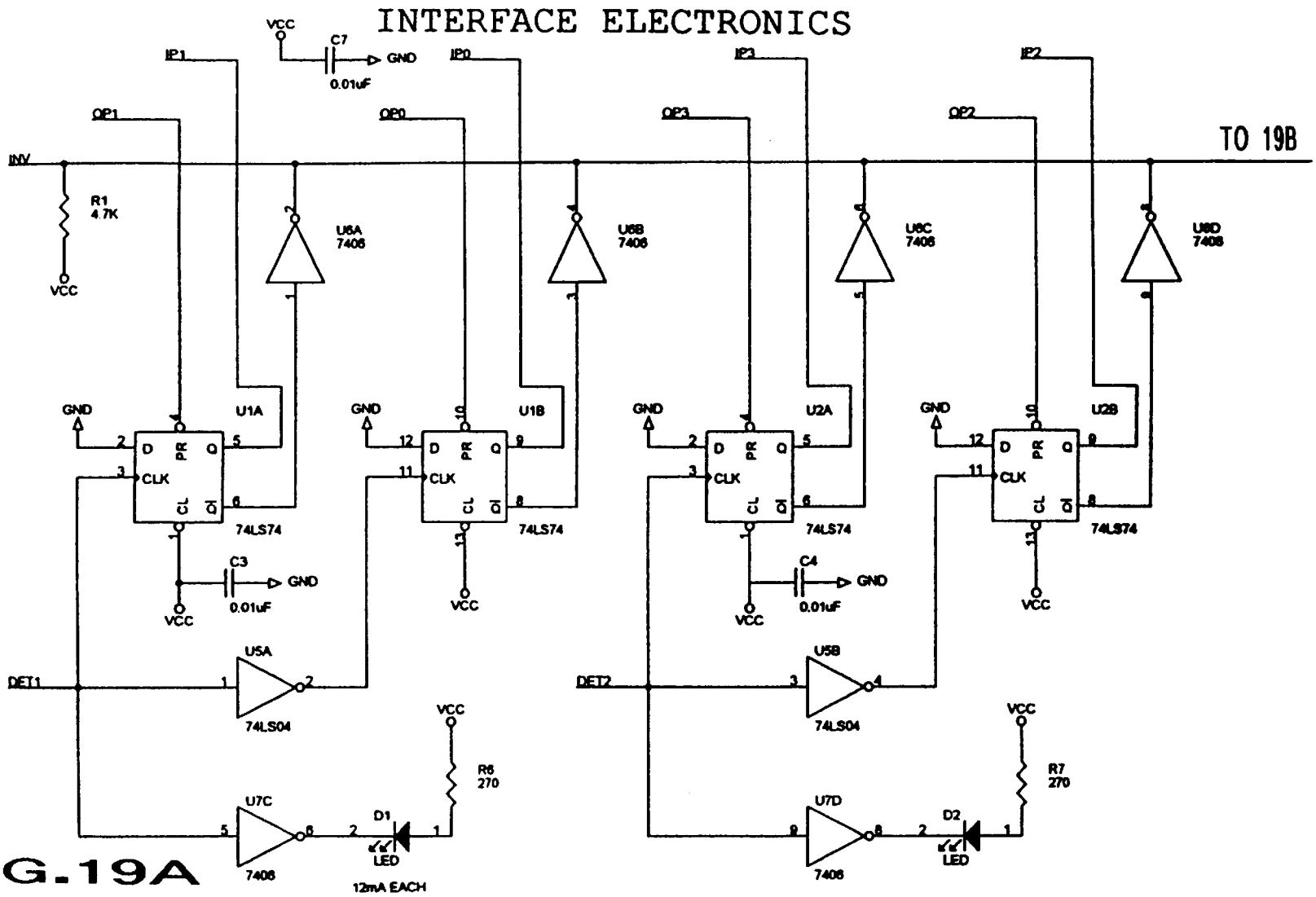
FIG. 19 is an electronic schematic diagram and cable identification for the interface electronics of FIG. 18.
Figure 19B:
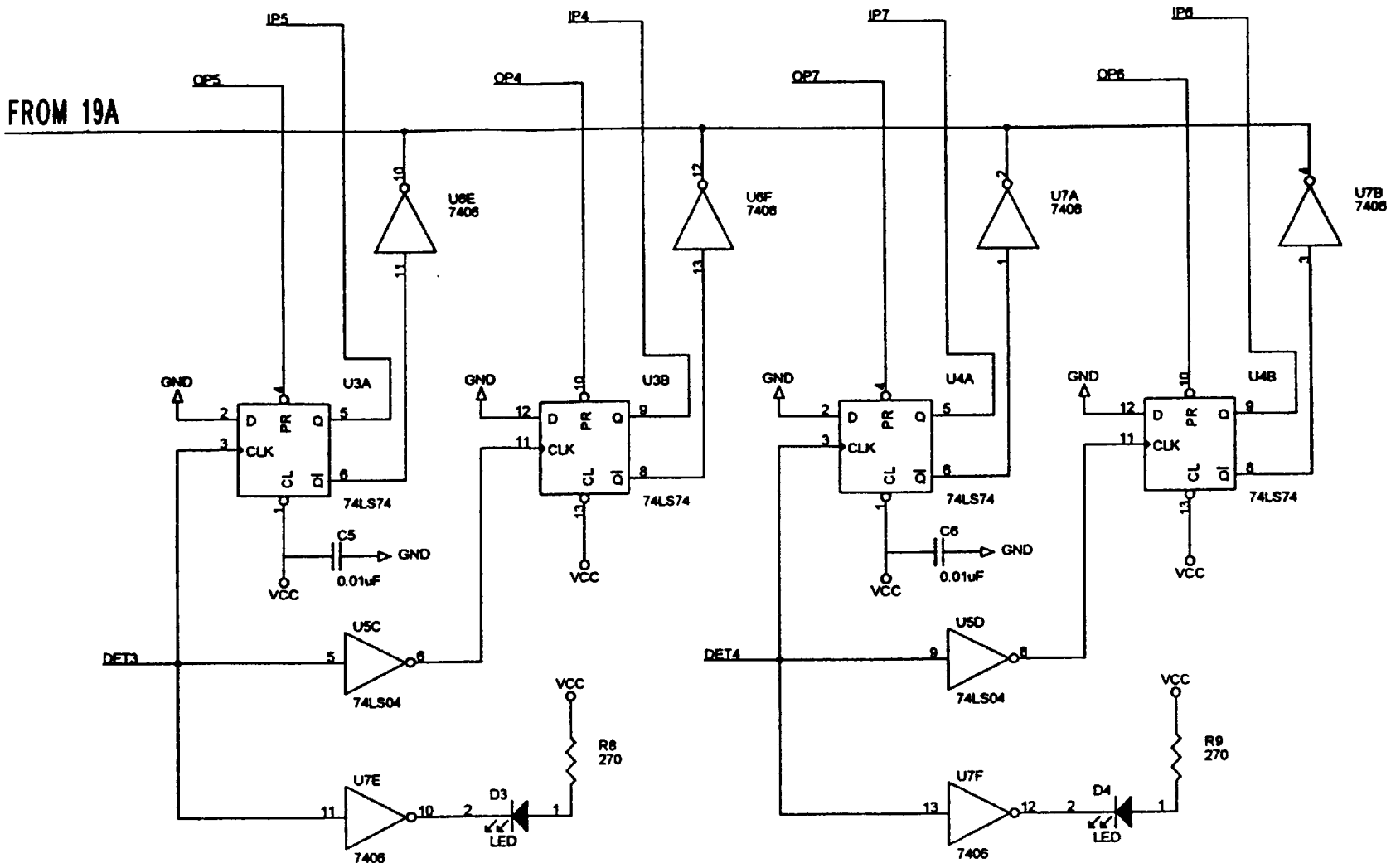
Figures 19, 19C:
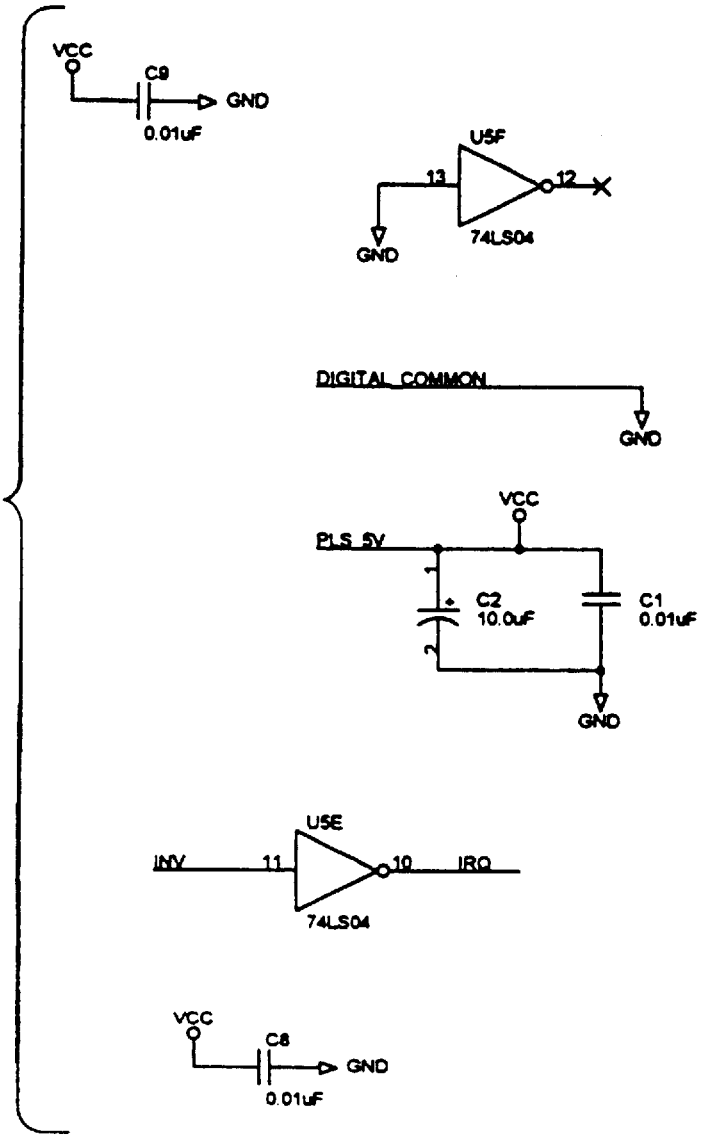
Figure 19D:
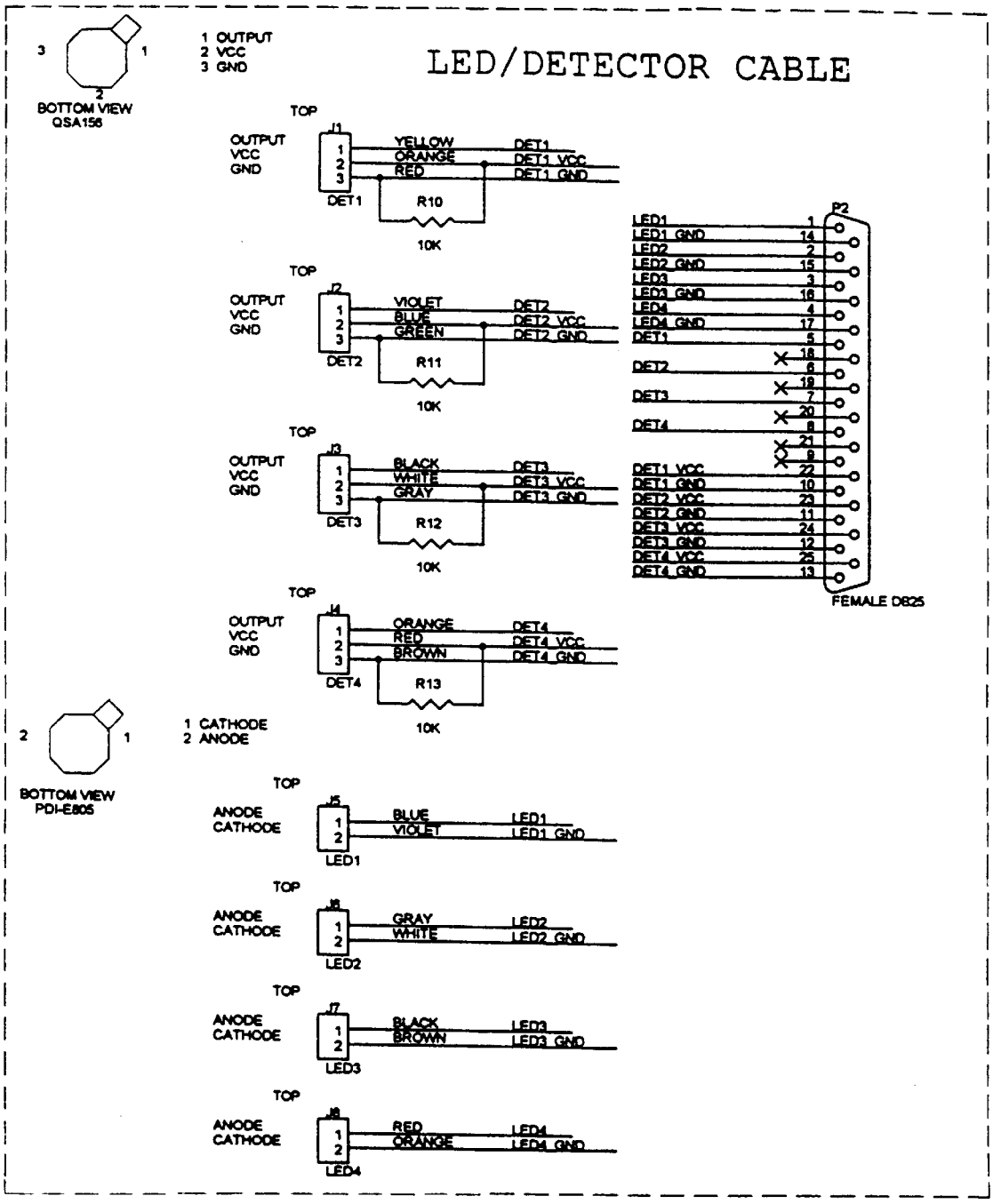
Figure 19E:
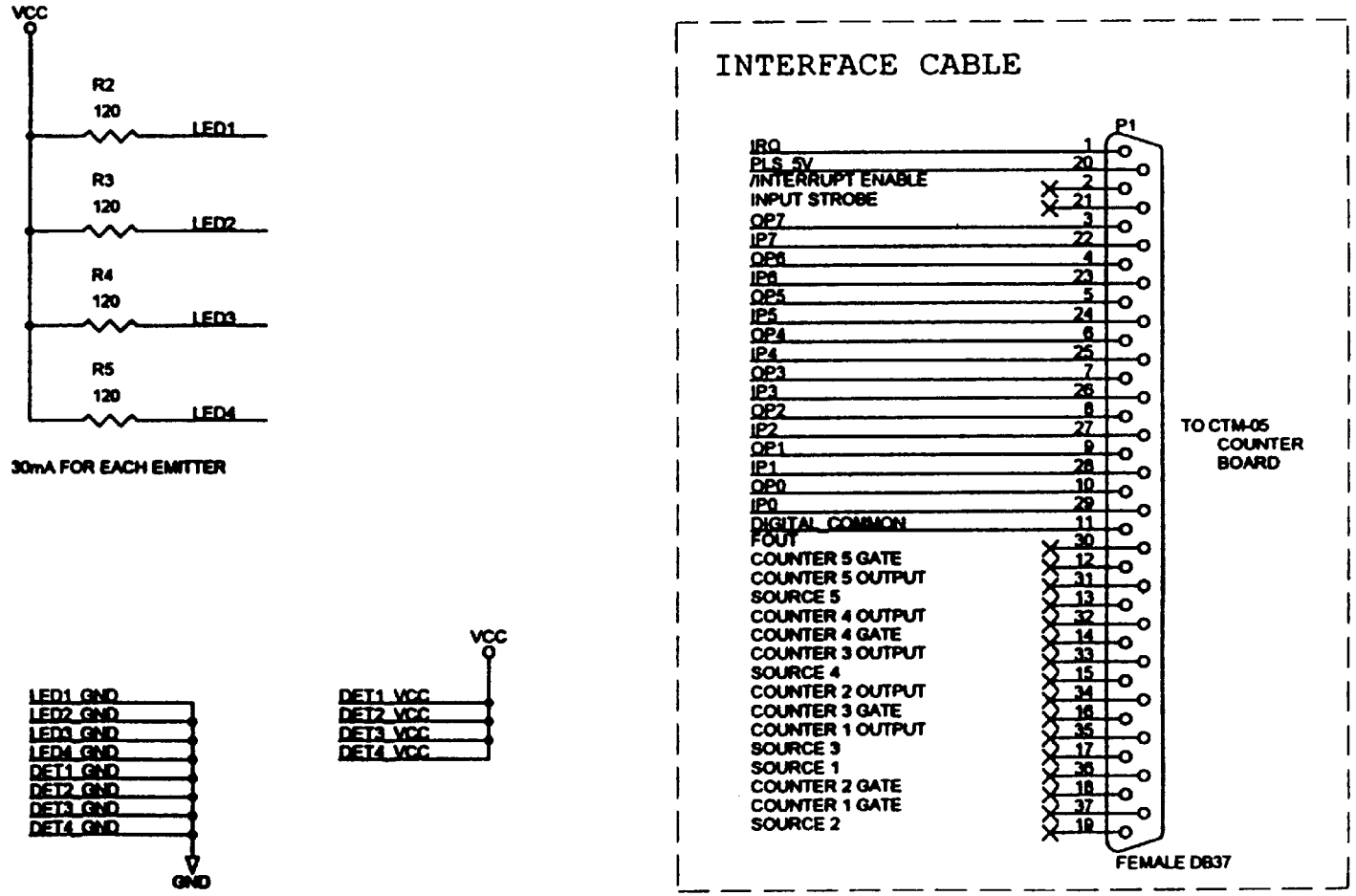
Figure 20:
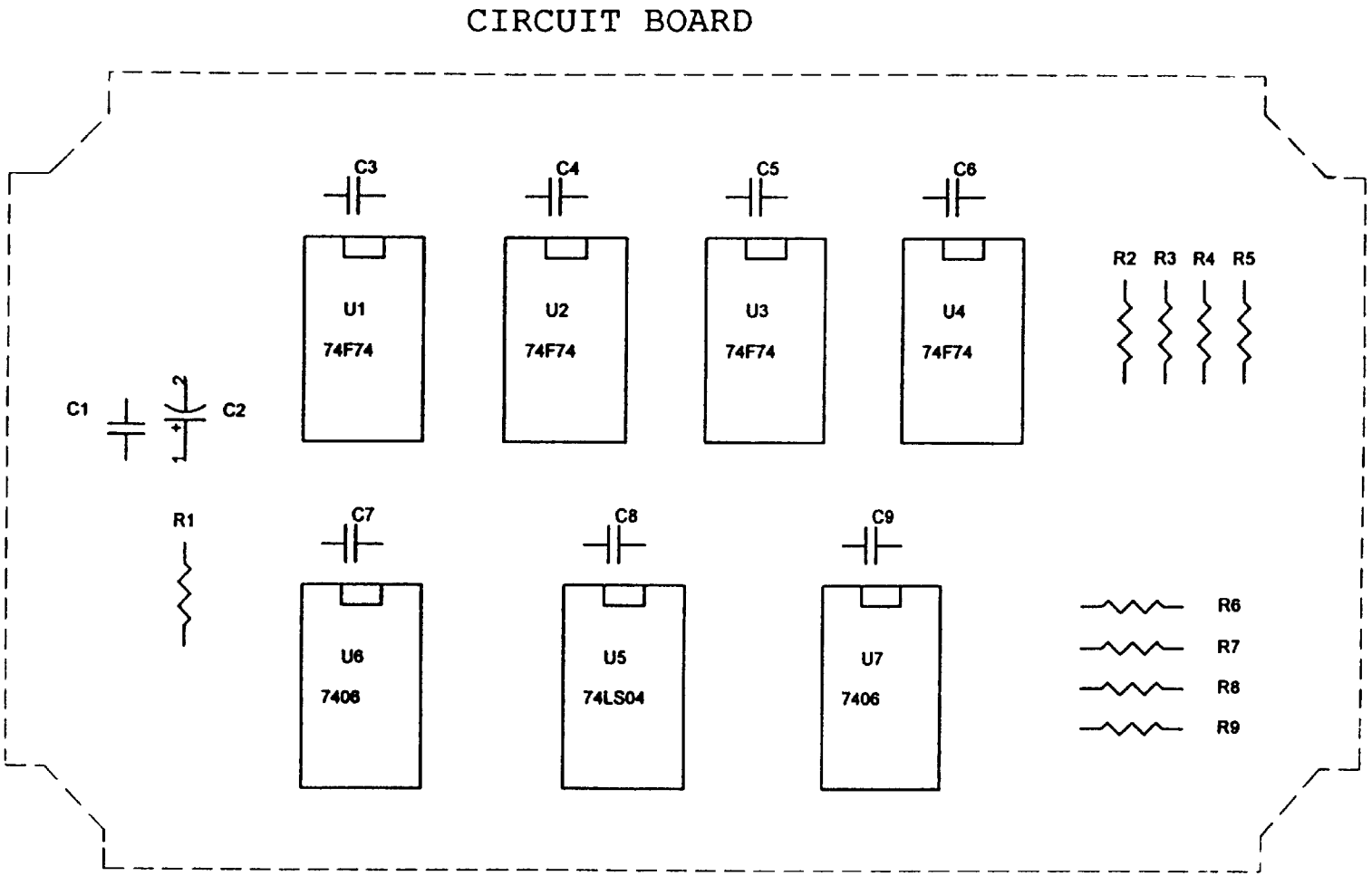
FIG. 20 is a layout diagram of the circuit board of the prototype of FIGS. 16 and 17.

The detector signal conditioner 31 and PC adapter card are located on the printed circuit card 33 shown in photograph, FIG. 17 in the layout shown in FIG. 19 including seven integrated circuits 40–46.

A block diagram showing one LED/Photodetector Path is shown in FIG. 18. The LED 20*a* is continuously running. Two interrupt signals are generated when the LED/Photodetector Path is broken. The first interrupt (start interrupt) designates the beginning of the path being broken and the second interrupt (stop interrupt) designates the path being clear again. The computer PC software records the time of each interrupt and the status or type of interrupt (start or stop) for this one LED/Photodetector pair 20*a,b* and 24*a,b*.

The start and stop interrupt-time values from all four detectors are collected by the PC software when a car passes through the LED/Photodetector paths. The PC software then processed these interrupts time values and generates data as outlined above.

The computer software employed accompanies this application as Appendix B. It is written in "C" and may be run on any IBM computer, 386 or better.

COMPONENT SPECIFICATION

LED Emitter: Photonic Detectors High Powered Infrared Emitter, 100 ma max current, 5 Degree Beam Angle, at 800 nm wavelength. TO 46 can with plastic collimating lens.

Photodetector: Optologic Model QSA 156, Silicon Photodetector with internal Schmitt Trigger that is TTL logic compatible. Hermetically sealed in TO5 can with plastic lens which has a field reception angle of ±12 deg.

SUMMARY

This describes a system to demonstrate the feasibility of a novel traffic axle detection technology using non-contact sensors. This system, called LAD, was shown to be feasible, in that the axle counting is 95 percent accurate for a wide range of modeled, four lane traffic conditions. Further, this technology was demonstrated in a 1/18 scale, two lane traffic demonstrator.

The advantages of this technology is the systems high accuracy for conditions from free-flowing traffic to stop-and-go conditions. Vehicle velocity, acceleration, gap, headway and lane flow measurement were demonstrated to be feasible through computer modeling, as well as techniques that will allow for lane displacement measurement. The LAD also has the advantage of allowing installation, maintenance, and removal without requiring access to (or modification of) the roadway. Thus the LAD represents a significant advantage in safety, lower operation costs, and improved traffic flow (traffic does not have to be stopped for LAD system access). Since the LAD mounts to the roadway shoulder, there are no engineering and installation support structures required. The LAD is, therefore, a potentially capable replacement for tape switches, air switches and treadles.

This application references axle detection in accordance with accepted terminology in the traffic monitoring field. In actuality, as discussed above, radiation beam interruption is by passage of vehicle wheels with one axle per wheel pair. The detection of two wheels as illustrated in FIG. 4 denotes the passage of a car or truck and motorcycle as well. A tractor-trailer passage is denoted by single axle wheel passage for the front of the tractor, typically dual wheels and axles for the rear of the tractor and dual wheels and axles for a single trailer. Any combination of these denotes the passage of a single classifiable vehicle.

In the foregoing description of this invention and the drawings, the radiation sources are shown for ease of understanding located at one side of the roadway and the radiation detectors at the opposite side. It is recognized that for convenience of installation and maintenance that it is possible to place radiation source and detector side by side on one side of the roadway and a retro-reflector device on the opposite side with the beam, when uninterrupted, traversing the roadway and bring reflection back to the detectors. In operation, the system is identical with the single passage version disclosed in the drawings. Such a retro-reflective system is considered as a part of this invention.

The above described embodiments of the present invention are merely descriptive of its principles and are not to be considered limiting. The scope of the present invention instead shall be determined from the scope of the following claims including their equivalents.

REFERENCES

1. Greenshields, B., "A Study of Traffic Capacity" in *Proc. Highway Research,* 14, Transportation Research Board, Washington D.C., 1034.
2. Haberman, R., *Mathematical Models: Mechanical Vibrations, Popular Dynamics and Traffic Flow*, Prentice-Hall, Inc., Englewood Cliffs, N.J., 1977.
3. U.S. Department of Transportation, *The* 1985 *Highway Capacity Manual*, Office of Traffic Operations, Federal Highway Administration, Washington, D.C., 1985.

APPENDIX B

```
/*****************************************************************************/
/*    CNTR.C                DERON LINSACUM                06/13/95
     =>              */
/*****************************************************************************/
/*                          INCLUDE FILES
#include <stdio.h>
#include <stdlib.h>
#include <string.h>
#Include <stdlib.h>
#include <time.h>
#include <math.h>
#include <mailoc.h>
#include <dos.h>
#include <conio.h>
#include <graph.h>
#include <bios.h>
#define P8259A 0×21
#define CTM05 0×300
#define CTM05_CMD (CTM05 + 0×01)
#define DIGITAL_IN (CTM05 + 0×02)
#define DIGITAL_OUT (CTM05 + 0×03)
#define KEY_a                97
#define KEY_A                65
#define KEY_b                98
#define KEY_B                66
#define KEY_c                99
#define KEY_C                67
#define KEY_f               102
#define KEY_F                70
#define KEY_h               104
#define KEY_H                72
#define KEY_i               105
#define KEY_I                73
#define KEY_m               109
#define KEY_M                77
#define KEY_n               110
#define KEY_N                78
#define KEY_o               111
#define KEY_O                79
#define KEY_r               114
#define KEY_R                82
#define KEY_s               115
#define KEY_S                83
#define KEY_t               116
#define KEY_T                84
#define KEY_v               118
#define KEY_V                86
#define KEY_x               120
#define KEY_X                88
#define KEY_ESC              27
#define KEY_y               121
#define KEY_Y                89
/*-------------------------------------------------------------------------*/
/* STACK AND POINTER CHECKING OFF                                          */
/*-------------------------------------------------------------------------*/
#pragma check_stack( off )
#pragma check_pointer( off )
#pragma intrinsic( _enable, _disable )
/*****************************************************************************/
/*                      EXTERNAL FUNCTIONS/VARIABLES                       */
/*****************************************************************************/
/*-------------------------------------------------------------------------*/
/* PROTOTYPES FOR INTERRUPT FUNCTIONS                                      */
/*-------------------------------------------------------------------------*/
void ( _cdecl _interrupt _far *oldroutine1)( );
void _cdecl _interrupt _far newroutine( void );
/*****************************************************************************/
/*                          LOCAL FUNCTIONS/VARIABLES                      */
int init_ctm05(void);
int alloc_data(void);
int display_data(void);
void init_isr(void);
void dis_isr(void);
int clear_data(void);
int process_data(void);
int check_keys(void);
int process(void);
unsigned int int_enable_mask;
unsigned int int_disable_mask;
```

APPENDIX B-continued

```
unsigned int int_number;
unsigned int counter_value;
long int num_points;
unsigned int low_byte;
unsigned int high_byte;
unsigned int status;
unsigned long int final_cntr_val;
unsigned long int cntr2_val;
unsigned Long int cntr2_val;
int ret_val;
long int det1_points;
long int det2_points;
long int det3_points;
long int det4_points;
int exit_program;
typedef struct
  {
  unsigned long int cntr_val;
  unsigned int status;
  }DATA;
struct det_status                /* this allows accessing individual groups of 2 b
  => its each using */
  {                               /* a single integer value */
  unsigned int det1:2;
  unsigned int det2:2;
  unsigned int det3:2;
  unsigned int det4:2;
  };
union stat_union             /* union of status bits with a single integer */
  {                   /* this allows updating of all bits with a single integer */
  unsigned int all;
  struct det_status bits;
  } stat;
/* to access a 2 bit group use this notation:       */
/*         variable = stat.bits.det1       */
/* define pointers for structured arrays */
/* one for the actual array and another for just a pointer to increment through
  => the array */
/* without destroying the original pointer position */
DATA _huge *det1;
DATA _huge *det1_ptr;
DATA _huge *det2;
DATA _huge *det2_ptr;
DATA _huge *det3;
DATA _huge *det3_ptr;
DATA _huge *det4;
DATA _huge *det4_ptr;
void main( )
{
exit_program = 1;
ret_val = 0;
num_points = 10000L;
det1_points = 0L;       /* reset variables that contain the current number of data p
  => oints taken */
det2_points = 0L;
det3_points = 0L;
det4_points = 0L;
init ctm05( );
ret_val = alloc_data( );
if(ret_val) exit(0);
system("cls");       /* clear screen */
_settextposition(6,20);
_outtext("HIT -- S -- KEY TO START DATA COLLECTION");
_settextposition(7,20);
_outtext("HIT -- ESC -- KEY TO EXIT PROGRAM");
while(exit_program)
  {
  check_keys( );
    /* now check if data array are full, if they are then process data */
    if( (det1_points >= num_points) || (det1_points >= num_points) ||
      (det1_points >= num_points) || (det1_points >= num_points) ) process( );
    }
exit(0);
}
/*************************************************************************/
int init_ctm05( )
{
/* initialize ctm05 counter */
outp(CTM05_CMD, 0x17);       /* select master mode register which is 16 bits */
```

APPENDIX B-continued

```
/* now set master mode register to 0xcad0 */
/* BIT 15 BCD SCALER                    */
/* BIT 14 DISABLE AUTO INCREMENT                    */
/* BIT 13 8 BIT DATA TRANSFER                    */
/* BIT 12 ENABLE FOUT SIGNAL                    */
/* BITS 11-8 SET CLOCK DIVIDERS TO DIVIDE BY TEN        */
/* BITS 7-4   SET INPUT SOURCE FOR FOUT TO F3(10KHZ)    */
/* BIT 3   DISABLE COMPARATOR 2 OUTPUT          */
/* BIT 2   DISABLE COMPARATOR 1 OUTPUT          */
/* BITS 1-0   DISABLE TIME OF DAY MODE          */
outp(CTM05, 0xd0);          /* low byte */
outp(CTM05, 0xca);          /* high byte */
/* now set individual counter modes          */
/* counters will operate in mode D (rate generator with no hardware gating) */
/* counters 1 and 2 will be concatenated together to provide a 32 bit counter */
/* counter 1 will be the low order bits(0-15) and counter 2 will be the high bit
   => s(16-31)    */
/* the counter will be set for a 10us resolution(100kHz)        */
/* this will allow the counter to run without resetting for about 11.9 hours    */
/* the counters will count up from 00000000H to ffffffffH and then repeat */
/* any negative numbered time duration caused by the reset can be corrected by s
   => ubtracting the */
/* start count value from the maximum counter count(FFFFFFFFH) and adding the fi
   => nish count value to it.   */
/* this assumes that the duration is less than 11.9 hours */
outp(CTM05_CMD, 0x01);          /* select 16 bit mode register for counter 1 */
/* BITS 15-13 INPUT GATE DISABLED TO COUNTER          */
/* BIT 12    COUNT ON RISING EDGE OF SOURCE INPUT    */
/* BITS 11-8   SOURCE SELECTION FROM F2 (100KHZ)       */
/* BIT 7     DISABLE SPECIAL GATE          */
/* BIT 6     RELOAD FROM LOAD          */
/* BIT 5     COUNT REPETITIVELY          */
/* BIT 4     COUNT IN BINARY          */
/* BIT 3     COUNT UP                */
/* BITS 2-0     OUTPUT CONTROL INACTIVE SET TO HIGH       */
outp(CTM05, 0x2c);       /* low byte */
outp(CTM05, 0x0c);       /* high byte */
outp(CTM05_CMD, 0x02);       /* select 16 bit mode register for counter 2 */
/* BITS 15-13 INPUT GATE DISABLED TO COUNTER   10 */
/* BIT 12       COUNT ON RISING EDGE OF SOURCE INPUT       */
/* BITS 11-8   SOURCE SELECTION FROM TERMINAL COUNT OF COUNTER 1 */
/* BIT 7        DISABLE SPECIAL GATE          */
/* BIT 6        RELOAD FROM LOAD          */
/* BIT 5        COUNT REPETITIVELY          */
/* BIT 4        COUNT IN BINARY          */
/* BIT 3        COUNT UP          */
/* BITS 2-0    OUTPUT CONTROL INACTIVE SET TO HIGH       */
outp(CTM05, 0x2c);       /* low byte */
outp(CTM05, 0x00);       /* high byte */
outp(CTM05_CMD, 0x03);       /* select 16 bit mode register for counter 3 */
/* BITS 15-13 INPUT GATE DISABLED TO COUNTER          */
/* BIT 12    COUNT ON RISING EDGE OF SOURCE INPUT    */
/* BITS 11-8   SOURCE SELECTION FROM F5 (100HZ)        */
/* BIT 7     DISABLE SPECIAL GATE          */
/* BIT 6     RELOAD FROM LOAD          */
/* BIT 5     COUNT REPETITIVELY          */
/* BIT 4     COUNT IN BINARY          */
/* BIT 3     COUNT UP                */
/* BITS 2-0       OUTPUT CONTROL INACTIVE SET TO HIGH    */
outp(CTM05, 0x2c);       /* low byte */
outp(CTM05, 0x0f);       /* high byte */
outp(CTM05_CMD, 0x04);       /* select 16 bit mode register for counter 4 */
/* BITS 15-13 INPUT GATE DISABLED TO COUNTER          */
/* BIT 12    COUNT ON RISING EDGE OF SOURCE INPUT    */
/* BITS 11-8   SOURCE SELECTION FROM F5 (100HZ)        */
/* BIT 7     DISABLE SPECIAL GATE          */
/* BIT 6     RELOAD FROM LOAD          */
/* BIT 5     COUNT REPETITIVELY          */
/* BIT 4     COUNT IN BINARY          */
/* BIT 3     COUNT UP                */
/* BITS 2-0     OUTPUT CONTROL INACTIVE SET TO HIGH       */
outp(CTM05, 0x2c);       /* low byte */
outp(CTM05, 0x0f);       /* high byte */
outp(CTM05_CMD, 0x05);       /* select 16 bit mode register for counter 5 */
/* BITS 15-13 INPUT GATE DISABLED TO COUNTER          */
/* BIT 12    COUNT ON RISING EDGE OF SOURCE INPUT    */
/* BITS 11-8   SOURCE SELECTION FROM F5 (100HZ)        */
/* BIT 7     DISABLE SPECIAL GATE          */
/* BIT 6     RELOAD FROM LOAD          */
```

APPENDIX B-continued

```
/* BIT 5     COUNT REPETITIVELY          */
/* BIT 4     COUNT IN BINARY          */
/* BIT 3     COUNT UP       10          */
/* BITS 2-0     OUTPUT CONTROL INACTIVE SET TO HIGH       */
outp(CTM05, 0x2c);       /* low byte */
outp(CTM05, 0x0f);       /* high byte */
/* now load a value of 0 into the load registers of counters 1 and 2 */
/* don't load any values to other counter load registers */
outp(CTM05_CMD, 0x09);       /* select 16 bit load register for counter 1 */
outp(CTM05, 0x00);       /* low byte */
outp(CTM05, 0x00);       /* high byte */
outp(CTM05_CMD, 0x0a);       /* select 16 bit load register for counter 2 */
outp(CTM05, 0x00);       /* low byte */
outp(CTM05, 0x00);       /* high byte */
/* now send command to transfer the load register contents for counters 1 and 2
   => */
outp(CTM05_CMD, 0x43);
outp(CTM05_CMD, 0x23);       /* arm counting for counters 1 and 2 only */
outp(DIGITAL_OUT, 0x00);       /* reset all detector interrupt flip-flops */
/* make all flip-flops active */
outp(DIGITAL_OUT, 0xff);       /* return presets to flip-flops to their normal high
   => state */
              /* for the ones that requested an interrupt */
return(0);
}
/*****************************************************************************/
int alloc_data( )
}
int ret_err;
ret_err = 0;
/* allocate memory space and set up detector data arrays */
if((det1 = (DATA_huge*) halloc(num_points, sizeof(DATA))) == NULL)
   {
   _settextposition(23,1);
   printf("\n Not enough memory for det1 array. \n");
   ret_err = 1;
   }
if((det2 = (DATA_huge*) halloc(num_points, sizeof(DATA))) == NULL)
   {
   _settextposition(23,1);
   printf("\n Not enough memory for det2 array. \n");
   ret_err = 1;
   }
if((det3 = (DATA_huge*) halloc(num_points, sizeof(DATA))) == NULL)
   {
   _settextposition(23,1);
   printf("\n Not enough memory for det3 array. \n");
   ret_err = 1;
   }
if((det4 = (DATA_huge*) halloc(num_points, sizeof(DATA))) == NULL)
   {
   _settextposition(23,1);
   printf("\n Not enough memory for det4 array. \n");
   ret_err = 1;
   }
/* assign data pointer to beginning of data array */
det1_ptr = det1;
det2_ptr = det2;
det3_ptr = det3;
det4_ptr = det4;
return(ret_err);
}
/*****************************************************************************/
int display_data( )
{
int jump_out;
long int i;
jump out = 1;
i = 0L;
system("cls");       /* clear screen */
det1_ptr = det1;       /* reinitialize pointer value */
det2_ptr = det2;
det3_ptr = det3;
det4_ptr = det4;
while(jump_out)
   {
   printf(" %lX    %lX    %lX    %lX\n", det1_ptr->cntr_val, det2_ptr->cntr_val,
                det3_ptr->cntr_val, det4_ptr->cntr_val);
   printf(" %x    %x    %x    %x\n", det1_ptr->status, det2_ptr->stat
```

APPENDIX B-continued

```
  => us,
                                det3_ptr->status, det4_ptr->status);
  det1_ptr++;
  det2_ptr++;
  det3_ptr++;
  det4_ptr++;
  if ( (det1_ptr->cntr_val = = 0L) && (det2_ptr->cntr_val = = 0L) &&
          (det3_ptr->cntr_val = = 0L) && (det4_ptr->cntr_val = = 0L)) jump_out = 0;
  i++;
  if(i >= num_points) jump_out = 0;
  }
det1_ptr = det1;      /* reinitialize pointer value */
det2_ptr = det2;
det3_ptr = det3;
det4_ptr = det4;
_settextposition(21,20);
_outtext("HIT ANY KEY TO CONTINUE");
getch( );
return(0);
}
/*****************************************************************************/
void init_isr( )
{
unsigned int intmask;
/*-----------------------------------------------------------------------------------------------------------*/
/*   SETUP INTERRUPT SERVICE ROUTINE (ISR)                                                                   */
/*-----------------------------------------------------------------------------------------------------------*/
/* set up masks for 8259A PIC. To enable the interrupt      */
/* this mask is ANDed with the mask register at 21h. To disable,    */
/* OR the disable mask with the mask register. The interrupt         */
/* number is 8 + the IRQ level of the interrupt. (due to the 8 NMI) */
/* parallel port 2's IRQ 5 TYPE 13 is used for this interrupt        */
/* note: _disable and _enable is used to prevent interrupts occuring while insta
  => lling new vector */
/* otherwise computer may get a wrong interrupt vector address and hang up */
/*          MASK REGISTER                    */
/* IRQ 7 6 5 4 3 2 1 0      */
/* bit   7 6 5 4 3 2 1 0   */
/*     1 1 0 1 1 1 1 1   ENABLE MASK VALUE & PORT(0x21)   */
/*     0 0 1 0 0 0 0 0   DISABLE MASK | PORT(0x21)   */
/*int_enable_mask = 0xf7;
int_disable_mask = 0x08;
int_number = 11;*/
int_enable_mask = 0xDF;
int_disable_mask = 0x20;
int_number = 13;
oldroutine1 = _dos_getvect(int_number);
_disable( );
_dos_setvect(int_number, newroutine);
_enable( );
/* now read 8259A's interrupt mask register and write it back after AND-ing it w
  => ith int_enable_mask */
/* this will enable IRQ5      */
_disable( );
intmask = (inp(P8259A) & int_enable_mask);
outp(P8259A, intmask);
_enable( );
}
void dis_isr( )
{
unsigned int intmask;
_disable( );
intmask = (inp(P8259A) | int_disable_mask):
outp(P8259A, intmask);
_dos_setvect(int_number, oldroutine1);
_enable( );
}
/*++++++++++++++++++++++++++++++++++++++++++++++++++++++++++++++++++++++++++++*/
/*                                                                            */
/*   INTERRUPT SERVICE ROUTINE ==>          void_interrupt_far newroutine( )  */
/*                                                                            */
/*      Routine Functions:                                                    */
/*                                                                            */
/*              1. Reset flip-flop on timer counter circuit.                  */
/*              2. Send byte info through P48 I/O board to drive scanner      */
/*                 motors.                                                    */
/*                                                                            */
/*++++++++++++++++++++++++++++++++++++++++++++++++++++++++++++++++++++++++++++*/
void _cdect _interrupt _far newroutine( )
```

APPENDIX B-continued

```
{
/* latch counter 1 and 2 counter values into hold register */
outp(*CTM05_CMD, 0xa3);
/* only one interrupt will be used for all flip-flops */
/* when a detector is blocked, the flip-flop will pull the interrupt line low */
/* now read in data byte for detector status */
/* BIT     7   6   5   4   3   2   1   0   */
/* DET   4F   4S    3F   3S    2F   2S   1F   1S    */
/*                                                  */
/* WHERE F = FINISH FLIP-FLOP       S = START FLIP-FLOP       */
/* if bit is equal to 0, then that detector's start or finish time will be recor
   => ded */
/* that flip-flop will then be reset individually */
/*now retreive counter 1 and 2 count values */
outp(CTM05_CMD, 0x11);       /* select hold register for counter 1 */
low byte = inp(CTM05);          /* read in counter 1 low byte */
high_byte = inp(CTM05);         /* read in counter 1 high byte */
counter_value = ((high byte >> 8) | low_byte);
cntr1_val = (unsigned long int)counter_value;
outp(CTM05_CMD, 0x12);       /* select hold register for counter 2 */
low_byte = inp(CTM05);          /* read in counter 2 low byte */
high_byte = inp(CTM05);         /* read in counter 2 high byte */
counter_value = ((high byte << 8) | low_byte);
cntr2_val = (unsigned long int)counter_value;
final_cntr_val = ((cntr2_val << 16) | cntr1_val);
stat.all = inp(DIGITAL_IN);
/* now reset flip-flops that were turned on */
outp(DIGITAL_OUT, 0x00);        /* RESET All FLIP FLOPS this eliminates zero v
   => alues for data */
/*outp(DIGITAL_OUT, stat.all);*/
outp(DIGITAL_OUT, 0xff);           /* return presets to flip-flops to their normal high
   => state */
            /* for the ones that requested an interrupt */
/* now route counter and status values to detector memory arrays */
if(stat.bits.det1 < 3)           /* check if need to record cntr value for this detec
   => tor */
   {
   det1_ptr->cntr val = final_cntr.val; /* values are a 32 bit number */
   det1_ptr->status = stat.bits.det1; /* values can be 0, 1, 2 */
                /* 0 -- start and finish of detector blockage occurred */
                /* at same time(unable to measure duration) */
                /* 1 -- finish of detector blockage */
                /* 2 -- start of detector blockage */
   det1_points++; /* increment current data points counter */
   det1_ptr++;   /* increment pointer for detector 1 data array */
   }
if(stat.bits.det2 < 3)       /* check if need to record cntr value for this detec
   => tor */
   {
   det2_ptr->cntr_val = final cntr_val;
   det2_ptr->status = stat.bits.det2;
   det2_points++;   /* increment current data points counter */
   det2_ptr++;   /* increment pointer for detector 1 data array */
   }
if(stat.bits.det3 < 3)       /* check if need to record cntr value for this detec
   => tor */
   {
   det3_ptr->cntr val = final_cntr_val;
   det3_ptr->status = stat.bits.det3;
   det3_points++;   /* increment current data points counter */
   det3_ptr++;   /* increment pointer for detector 1 data array */
   }
if(stat.bits.det4 < 3)       /* check if need to record cntr value for this detec
   => tor */
   {
   det4_ptr->cntr_val = final_cntr_val;
   det4_ptr->status = stat.bits.det4;
   det4_points++;       /* increment current data points counter */
   det4_ptr++;       /* increment pointer for detector 1 data array */
   }
outp(0x20, 0x20);
}
/*************************************************************************/
int clear_data( )
{
long int ii;
det1_ptr = det1;       /* reinitialize pointer value */
det2_ptr = det2;
det3_ptr = det3;
```

APPENDIX B-continued

```
det4_ptr = det4;
for(ii = 0; ii<num_points; ii++)
  {
  det1_ptr->cntr_val = 0L;
  det1_ptr->status = 0;
    det2_ptr->cntr_val = 0L;
  det2_ptr->status = 0;
  det3_ptr->cntr_val = 0L;
  det3_ptr->status = 0;
  det4_ptr->cntr_val = 0L;
  det4_ptr->status = 0;
  det1_ptr++;
  det2_ptr++;
  det3_ptr++;
  det4_ptr++;
  }
det1_ptr = det1;      /* reinitialize pointer value */
det2_ptr = det2;
det3_ptr = det3;
det4_ptr = det4;
det1_points = 0L;      /* reset variables that contain the current number of data p
  => points taken */
det2_points = 0L;
det3_points = 0L;
det4_points = 0L;
return(0);
}
/*****************************************************************************/
* TAG( )
*
* Description:
*
* Returns:
*                    . . .
* Inputs:
*
* Outputs:
*                    . . .
* Considerations:
*                    . . .
* Assumptions:
*                    . . .
* Related Routines:
*                    . . .
*****************************************************************************/
int check_keys()
{
unsigned int ascii_val;/
unsigned int scan_code;
unsigned int keyactive;
if(kbhit( ))
  {
ascii_val = getch( ); /* get ascii value *,
keyactive = ascii_val;
if(ascii_val = = 0)
  {
  scan_code = getch( ); /* get scan code */
  }
/*printf(" keyactive = %d, scan_code = %d    ", keyactive, scan_code);*/
switch(keyactive)
  {
  /*= = = = = = = = = = = = = = = = = = = = = = = =
  = f,F - PROCESS DATA AND DISPLAY IT
  /*= = = = = = = = = = = = = = = = = = = = = = = = =*/
  case KEY_f: case KEY_F:
    process( );
    break;
  /*= = = = = = = = = = = = = = = = = = = = = = = =
  = s,S - start data collection
  /*= = = = = = = = = = = = = = = = = = = = = = = = =*/
  case KEY_s: case KEY_S:
    system("cis");      /* clear screen */
    outp(DIGITAL_OUT, 0x00); /* reset all detector interrupt flip-flops *
=> /
    _settextposition(6,20);
    _outtext("DATA ARRAYS CLEARED");
    clear_data( );   /* clear data arrays */
    _settextposition(7,20);
    _outtext("DETECTOR INTERRUPTS CLEARED");
```

APPENDIX B-continued

```
      outp(DIGITAL_OUT, 0xff);      /* return presets to flip-flops to their norma
=>l high state */
      _settextposition(8,20);
      _outtext("DATA-CAPTURE ENABLED");
      _settextposition(9,20);
      _outtext("HIT -- F --- KEY TO PROCESS DATA");
      init_isr( );
      break;
   /*= = = = = = = = = = = = = = = = = = = = = = = =
= esc - exit program
   /*= = = = = = = = = = = = = = = = = = = = = = = =*/
   case KEY_ESC:
      system("cls");    /* clear screen */
         dis_isr( );     /* disengage interrupt service routine */
      /* unallocate memory space */
      hfree(det1);
      hfree(det2);
      hfree(det3);
      hfree(det4);
         exit_program = 0;
         break;
      default:
         break;
      }
   fflush(stdin);          /* FLUSH KEYBOARD BUFFER */
   }
return(0);
}
/*****************************************************************************
* TAG( )
*
* Description:
*
* Returns:
*                  . . .
* Inputs:
*
* Outputs:
*                  . . .
* Considerations:
*                  . . .
* Assumptions:
*                  . . .
* Related Routines:
*                  . . .
*****************************************************************************/
int process_data( )
{
/* process data here */
/* for now just displaying data arrays */
display_data( );
return(0);
}
/*****************************************************************************/
int process( )
{
system("cis");    /* clear screen */
_settextposition(6,20);
_outtext("DATA-CAPTURE DISABLED");
dis_isr( );    /* disable interrupt routine */
_settextposition(7,20);
_outtext("PROCESSING DATA");
process_data( );
system("cls");    /* clear screen */
_settextposition(6,20);
_outtext("HIT -- S -- TO START DATA COLLECTION");
_settextposition(7,20);
_outtext("HIT -- ESC KEY -- TO EXIT PROGRAM");
return(0);
}
```

What is claimed is:

1. A traffic monitoring system for roadways having a plurality of lanes and opposite roadway edges comprising:

a) a plurality of radiation sources adapted to be positioned at one edge of a multi-laned roadway with radiation beams from each source directed across the roadway;

b) a plurality of radiation detectors adapted to be positioned and oriented to detect radiation from a corresponding radiation light source after crossing the roadway;

c) at least one additional pair of corresponding radiation sources and radiation detectors defining pair of angled radiation paths extending across the roadway which crosses the roadway along side radiation paths;

and means responsive to the interruption of radiation paths of said sets of radiation source and radiation detectors by passing vehicles on said roadway for monitoring the vehicles in different lanes of said roadway and different directions.

2. A system in accordance with claim 1 including a plurality of additional pairs of sets of radiation sources and radiation detectors define a plurality of angled intersecting cross paths extending across the roadway.

3. A system in accordance with claim 1 including at least one set of radiation source and radiation detector defining a direct radiation path across the roadway which does not cross any other radiation path.

4. A system is accordance with claim 1 wherein said radiation sources comprises light emitting diodes and means for powering said light emitting diodes.

5. A system in accordance with claim 1 wherein said radiation detectors comprises photo detectors.

6. A system in accordance with claim 1 wherein an additional set of radiation source and radiation detector is positioned to define a parallel radiation path for at least some of said sets of angled paths between the radiation sources and radiation detectors.

7. A system in accordance with claim 6 wherein said additional set of radiation source and radiation detectors is positioned at a predetermined distance along the length of the roadway from its adjacent set of radiation source and radiation detectors.

8. The system in accordance with claim 1 wherein said monitoring means comprises means for converting radiation interruptions at a respective radiation detector into a series of binary electrical signals.

9. A system in accordance with claim 8 wherein said monitoring means including gating means for defining a time window for responding to binary electrical signals corresponding to radiation path interruptions within said time window as a function of lane distribution of vehicles.

10. The system in accordance with claim 1 wherein said beam interruption responsive means detects the velocity of vehicles in a lane in accordance with the time delay between radiation beam interruptions in said sets of plurality of radiation sources and plurality of radiation detectors and the lane identification in accordance with the order of beam interruptions as detected by said additional pair of radiation sources and radiation detectors.

11. A traffic monitor in combination with a roadway having a plurality of lanes and first and second sides of the roadway for installation of traffic monitors comprising:

a first radiation source positioned at the first side of the roadway for directing a beam of radiation across the lanes of the roadway;

a first radiation detector positioned and directed to detect radiation from said first radiation source after crossing the roadway;

a second radiation source positioned at one side of the roadway and spaced from said first radiation source a distance along the roadway from said first radiation source for directing a beam of radiation from across the lanes of the roadway;

a second radiation detector positioned and directed to detect radiation from said second radiation source after crossing the roadway;

at least two additional radiation sources positioned at a side of said roadway each directed to radiate across the roadway with the beams of radiation following paths which cross each other between the sides of the roadway;

at least two additional radiation detectors positioned and directed to detect beams of radiation from respective radiation sources after crossing the roadway; and means coupled to said radiation detectors and responsive to interruption of radiation at said radiation detectors for determining the vehicle traffic in individual lanes of said roadway and for determining vehicle traffic in different directions.

12. A traffic monitor in accordance with claim 11 wherein all of said radiation sources are positioned on the same side of said roadway.

13. A combination in accordance with claim 11 wherein said first and second radiation sources are positioned to direct radiation generally normal to the direction of vehicle movement on said roadway.

14. A combination in accordance with claim 11 wherein said additional radiation sources and additional radiation detectors are at least four in number.

15. A combination in accordance with claim 11 wherein said means for determining vehicle traffic comprises a programmed computer, said computer being programmed to calculate as a function of interruption of radiation as detected by said radiation detectors, at least one of the following:

vehicle velocity in a lane;

vehicle acceleration in a lane;

vehicle position in a lane.

16. A combination in accordance with claim 11 wherein said determining means includes means for generating a time window for passing signals responsive to a vehicle in a lane.

17. The combination in accordance with claim 16 wherein said time window generating means is responsive to the interruption of a radiation beam to open a time window.

18. The combination in accordance with claim 11 wherein said additional radiation sources are directed across said roadway at substantially the same angle with respect to the direction of vehicle movement on said roadway.

19. A traffic monitor in combination with a roadway having a plurality of lanes and first and second sides of the roadway for installation of traffic monitors comprising:

a first radiation source positioned at the first side of the roadway for directing a beam of radiation across the lanes of the roadway;

a first radiation detector positioned and directed to detect radiation from said first radiation source after crossing the roadway;

a second radiation source positioned at one side of the roadway and spaced from said first radiation source a distance along the roadway from said first radiation source for directing a beam of radiation from across the lanes of the roadway;

a second radiation detector positioned and directed to detect radiation from said second radiation source after crossing the roadway;

at least two additional radiation sources positioned at a side of said roadway each directed to radiate across the roadway with the beams of radiation following paths which cross each other between the sides of the roadway;

at least two additional radiation detectors positioned and directed to detect beams of radiation from respective radiation sources after crossing the roadway; and means coupled to said radiation detectors and responsive to interruption of radiation at said radiation detectors for determining the vehicle traffic in individual lanes of said roadway;

wherein the said same angle is between 0° and 20° with respect to the normal with respect to the lanes of said roadway.

20. The combination in accordance with claim 11 wherein said radiation sources produces a series of radiation pulses.

21. The combination in accordance with claim 11 wherein said programmed computer discriminates between vehicles in different lanes by the logic of order of beam crossing interruptions.

22. A vehicle monitoring system for multi-laned roadways comprising:

a pair of radiation sources;

means for positioning said radiation sources at one side of a roadway at a predetermined distance along the roadway and with beams from said radiation sources crossing each other and the roadway;

a pair of radiation detectors positioned to detect radiation crossing the roadway;

means positioning each of said radiation detectors to detect radiation from a respective one of said radiation sources;

vehicle velocity beam detection means comprising means for opening a time window responsive to interruption of the said first beam crossing by a vehicle;

signal processing means for processing beam interruptions between said first and second radiation source for determining vehicle velocity; and signal processing means for processing beam interruption of the crossed beams for determining lane location of vehicles interrupting said beams for vehicles traveling in different directions.

* * * * *